US006905367B2

(12) United States Patent
Crane, Jr. et al.

(10) Patent No.: US 6,905,367 B2
(45) Date of Patent: Jun. 14, 2005

(54) MODULAR COAXIAL ELECTRICAL INTERCONNECT SYSTEM HAVING A MODULAR FRAME AND ELECTRICALLY SHIELDED SIGNAL PATHS AND A METHOD OF MAKING THE SAME

(75) Inventors: Stanford W. Crane, Jr., San Jose, CA (US); Myoung-soo Jeon, Fremont, CA (US); Josh Nickel, Santa Clara, CA (US)

(73) Assignee: Silicon Bandwidth, Inc., Fremont, CA (US)

( * ) Notice: Subject to any disclaimer, the term of this patent is extended or adjusted under 35 U.S.C. 154(b) by 0 days.

(21) Appl. No.: 10/195,470

(22) Filed: Jul. 16, 2002

(65) Prior Publication Data

US 2004/0014360 A1 Jan. 22, 2004

(51) Int. Cl.[7] ..... H01R 13/648; H01R 13/502; H01R 13/514

(52) U.S. Cl. ..... 439/608; 439/701

(58) Field of Search ..... 439/608, 607, 439/701, 609, 108, 101

(56) References Cited

U.S. PATENT DOCUMENTS

| | | | | |
|---|---|---|---|---|
| 3,201,722 A | | 8/1965 | May et al. | |
| 3,366,920 A | | 1/1968 | Laudig et al. | |
| 4,605,269 A | | 8/1986 | Cohen et al. | |
| 4,686,607 A | * | 8/1987 | Johnson | 361/788 |
| RE32,760 E | * | 10/1988 | Chandler et al. | 439/188 |
| 4,842,528 A | | 6/1989 | Frantz | |
| 4,861,271 A | | 8/1989 | Bogar et al. | |
| 4,900,258 A | | 2/1990 | Hnatuck et al. | |
| 5,011,425 A | | 4/1991 | Van Zanten et al. | |
| 5,055,068 A | | 10/1991 | Machura et al. | |
| 5,088,937 A | | 2/1992 | Gabany | |
| 5,116,245 A | | 5/1992 | Baker | |
| 5,161,991 A | | 11/1992 | Bauer | |
| 5,169,343 A | | 12/1992 | Andrews | |
| 5,228,871 A | * | 7/1993 | Goodman | 439/607 |
| 5,344,340 A | | 9/1994 | Bouleau | |
| 5,397,241 A | | 3/1995 | Cox et al. | |
| 5,484,310 A | | 1/1996 | McNamara et al. | |
| 5,516,294 A | | 5/1996 | Andrews et al. | |
| 5,516,307 A | | 5/1996 | Cartesse et al. | |
| 5,575,688 A | | 11/1996 | Crane, Jr. | |
| 5,577,935 A | | 11/1996 | Harting et al. | |
| 5,595,490 A | | 1/1997 | Cohen et al. | |
| 5,605,476 A | | 2/1997 | McNamara et al. | |
| 5,607,326 A | | 3/1997 | McNamara et al. | |
| 5,641,294 A | | 6/1997 | Beard | |
| 5,645,454 A | | 7/1997 | Kosmala | |

(Continued)

FOREIGN PATENT DOCUMENTS

| | | |
|---|---|---|
| WO | PC-WO 87/07441 | 12/1987 |
| WO | PC-WO 90/09686 | 8/1990 |
| WO | PC-WO 97/02629 | 1/1997 |
| WO | PC-WO 97/40554 | 10/1997 |

*Primary Examiner*—Chandrika Prasad
(74) *Attorney, Agent, or Firm*—McKenna Long & Aldridge LLP

(57) ABSTRACT

A modular connector assembly includes a modular frame having a first holes, second holes, and third holes formed at evenly spaced intervals. A plurality of modular interconnect components, fixable within the modular frame, have a back surface projection formed thereon. Each modular interconnect includes a contact housing made of electrically insulating material, an exterior of the contact housing comprising first and second side surfaces, a back surface, and a top surface. Contact signal pins are fixed within and electrically insulated from the contact housing.

75 Claims, 29 Drawing Sheets

U.S. PATENT DOCUMENTS

| | | | | |
|---|---|---|---|---|
| 5,672,064 A | | 9/1997 | Provencher et al. | |
| 5,675,891 A | * | 10/1997 | Childs et al. | 29/879 |
| 5,679,006 A | | 10/1997 | Madelaine | |

5,702,258 A 12/1997 Provencher et al.
5,718,606 A 2/1998 Rigby et al.
5,775,947 A * 7/1998 Suzuki et al. ..... 439/608
5,795,191 A * 8/1998 Preputnick et al. ..... 439/608
5,842,872 A 12/1998 Hosler, Sr. et al.
5,851,121 A 12/1998 Thenaisie et al.
5,882,227 A 3/1999 Neidich
5,919,063 A 7/1999 Wang
5,938,450 A * 8/1999 Nagafuji ..... 439/63
5,943,770 A 8/1999 Thenaisie et al.
5,980,321 A 11/1999 Cohen et al.
5,993,259 A 11/1999 Stokoe et al.
6,037,787 A 3/2000 Corwith
6,056,559 A * 5/2000 Olson ..... 439/108
6,071,127 A 6/2000 Acke et al.
6,120,306 A 9/2000 Evans
6,137,064 A 10/2000 Kiani et al.
6,152,742 A 11/2000 Cohen et al.
6,152,747 A 11/2000 McNamara
6,171,149 B1 * 1/2001 van Zanten ..... 439/608
6,179,663 B1 1/2001 Bradley et al.
6,224,423 B1 * 5/2001 Yip et al. ..... 439/608
6,270,366 B1 8/2001 Jeon et al.
6,293,827 B1 9/2001 Stokoe
6,299,483 B1 10/2001 Cohen et al.
6,305,947 B1 10/2001 Bruce
6,322,379 B1 11/2001 Ortega et al.
6,354,877 B1 * 3/2002 Shuey et al. ..... 439/608
6,540,559 B1 * 4/2003 Kemmick et al. ..... 439/608
2002/0111068 A1 * 8/2002 Cohen et al. ..... 439/608

* cited by examiner

MODULAR COAXIAL ELECTRICAL INTERCONNECT SYSTEM HAVING A MODULAR FRAME AND ELECTRICALLY SHIELDED SIGNAL PATHS AND A METHOD OF MAKING THE SAME

BACKGROUND OF THE INVENTION

1. Field of the Invention

The present invention relates in general to electrical connectors. More particularly, the present invention relates to a connector assembly for use in coaxial connection with circuit boards. Even more particularly, this invention relates to electrical connectors having densely packed contact members capable of passing signals while minimizing cross talk between adjacent contact members and increasing electrical efficiencies, especially at high frequencies.

2. Discussion of the Related Art

Electrical interconnect systems (including electronic interconnect systems) are used for interconnecting electrical and electronic systems and components. In general, electrical interconnect systems include both a male interconnect component, such as a conductive pin, and a female interconnect component, such as a conductive socket. In these types of electrical interconnect systems, electrical interconnection is accomplished by inserting the male interconnect component into the female interconnect component. Such insertion brings the conductive pin and socket into contact with each other so that electrical signals may be transmitted through the interconnect components. In a typical interconnect system, a plurality of individual conductive pins are positioned in a grid formation and a plurality of individual conductive sockets are arranged to receive the individual pins, with each pin and socket pair transmitting a different electrical signal.

Regardless of the exact application, electrical connector designs have generally needed to mirror trends in the electronics industry. Electronic systems have generally gotten smaller and faster. They also handle much more data than systems built just a few years ago. These trends mean that electrical connectors must carry more and faster data signals in a smaller space without degrading the signal. Accordingly, computer and telecommunication applications require high density interconnect systems for transferring signals between circuit boards and attached devices. Additionally, as voltages have become smaller, due to smaller transistor features and spacing, the noise allowed for these devices has also been reduced.

High density electrical interconnect systems are characterized by the inclusion of a large number of pin/socket connections within a small area. By definition, high density electrical interconnect systems have a greater number of connections in the same space as required by lower density interconnect systems and also include shorter signal paths than lower density interconnect systems. Short signal paths associated with high density interconnect systems allow high density electrical interconnect systems to transmit electrical signals at higher speeds. The high speed signals that are transferred through such interconnections are susceptible to cross talk due to the signal speeds and proximate locations of the signal carrying conductors adjacent to each other. Because the trend in modern telecommunications equipment and computers requires higher current densities, while operating at lower voltages, there is a need for interconnect systems to connect such higher density circuits while avoiding the introduction of cross talk, reflections and transmission loss, due to the density of signal paths carried by such interconnect systems.

The term "cross talk" refers to electromagnetic coupling between signal paths. As signal paths are placed closer together, the amount of electromagnetic coupling between the signal paths increase. Electromagnetic coupling also increases as the speed of the signals increase.

A traditional method of reducing cross talk is to use ground pins within the field of signal pins. The disadvantage of this approach, however, is that it reduces the effective density of the connectors, as often the ground pins outnumber the signal pins by a wide margin.

Thus, there is a need in the art for a high density electrical interconnect system that reduces or eliminates cross talk between closely spaced electrical signal paths. It would also be highly desirable if the electrical interconnect system were easy to manufacture.

SUMMARY OF THE INVENTION

Accordingly, the present invention is directed to utilizing coaxial interconnections in a very dense interconnect structure that substantially obviates one or more of the problems due to limitations and disadvantages of the related art.

An advantage of the present invention is to provide increased signal speed through the use of coaxial contacts assembled as a series of modules.

Another advantage of the present invention is to provide more efficient utilization of the space on the printed wiring board to which the connector is attached due to the density achieved.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, a modular connector assembly may include a modular frame having a first surface and a second surface connected at an angle to each other at a first angle region. The first surface, second surface, and the first angle region include first holes, second holes, and third holes, respectively, that are formed at evenly spaced intervals. Modular interconnect components, fixable within the modular frame, each including a back surface having a back surface projection, a contact housing made of electrically insulating material, wherein an exterior of the contact housing includes first and second side surfaces, a back surface, and a top surface. Contact signal pins may be fixed within and electrically insulated from the contact housing. Side protrusions formed on the first side surface. Side recesses may be formed in the second side surface. At least one back surface peg may be formed on the back surface of the contact housing. Top surface modular frame connection means may be formed on the top surface. The top surface modular frame connection means may be configured for receipt by the first holes, the back surface projection may be configured for receipt by the second holes, the at least one back surface peg may be configured for receipt by the third holes, and wherein side protrusions of the plurality of modular interconnect components may be configured for receipt by side recesses of adjacent ones of the plurality of modular interconnect components.

It is to be understood that both the foregoing general description and the following detailed description are exemplary and explanatory and are intended to provide further explanation of the invention as claimed.

BRIEF DESCRIPTION OF THE DRAWING

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE ILLUSTRATED EMBODIMENTS

Reference will now be made in detail to an embodiment of the present invention, example of which is illustrated in the accompanying drawings.

Figure 1A:
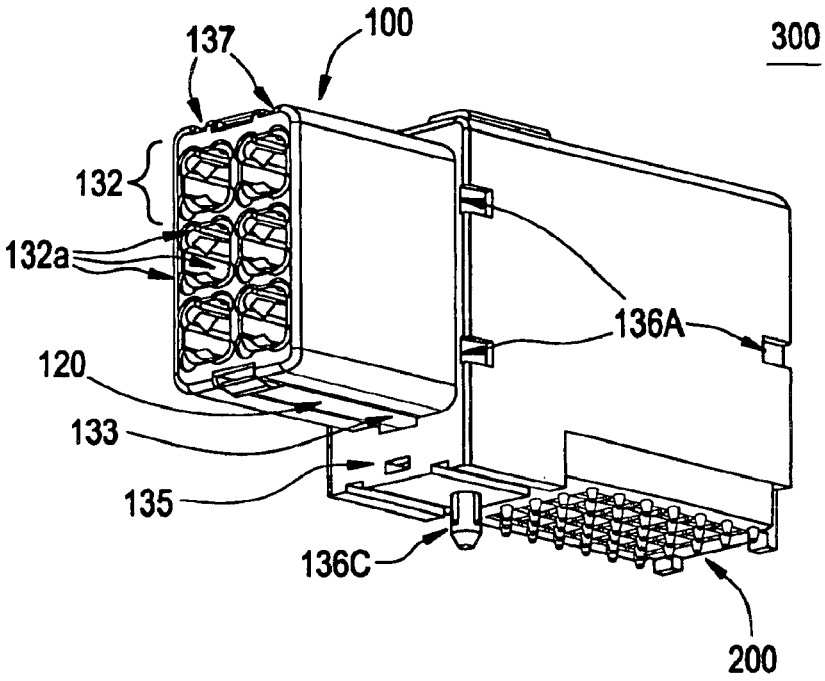
FIGS. 1A and 1B illustrate perspective front and back views of the modular female interconnect component in accordance with the principles of the present invention.
Figure 1B:
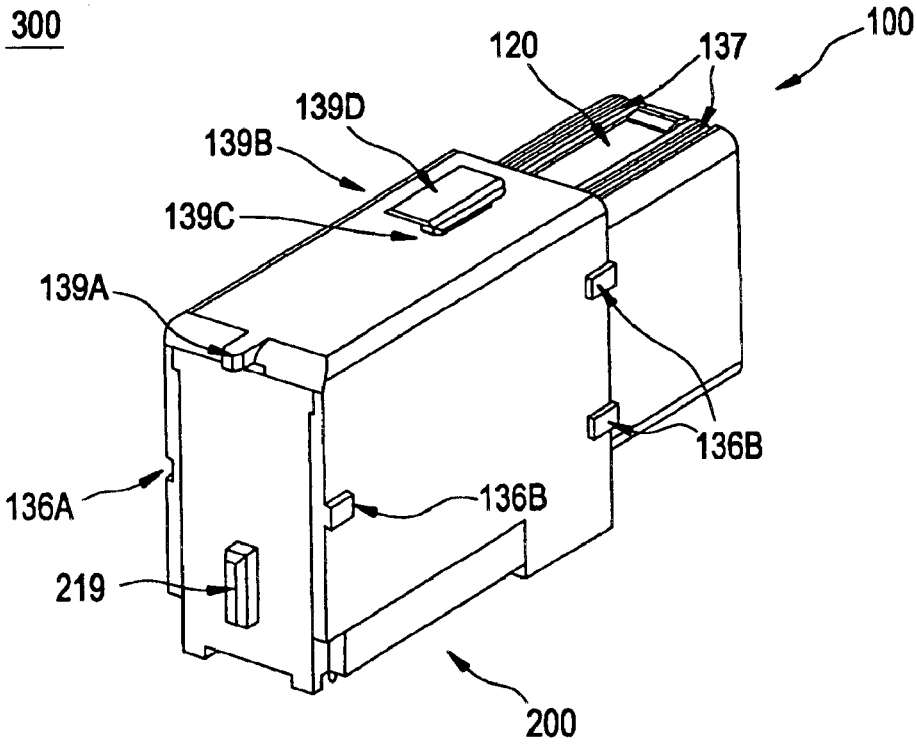

Referring to FIGS. 1A and 1B, front and back views, respectively, are provided of a modular female interconnect component 300 comprising coaxial reception type connections according to the principles of the present invention generally comprises a female unit 100 electrically and mechanically connected to a female right angle unit 200.

Referring to FIGS. 3 and 4A–4F, an exploded view of the female unit 100 of the modular female interconnect component 300 shown in FIGS. 1A and 1B and perspective views of its individual components offers a detailed description of the female unit and its manufacture.

Figure 4A:
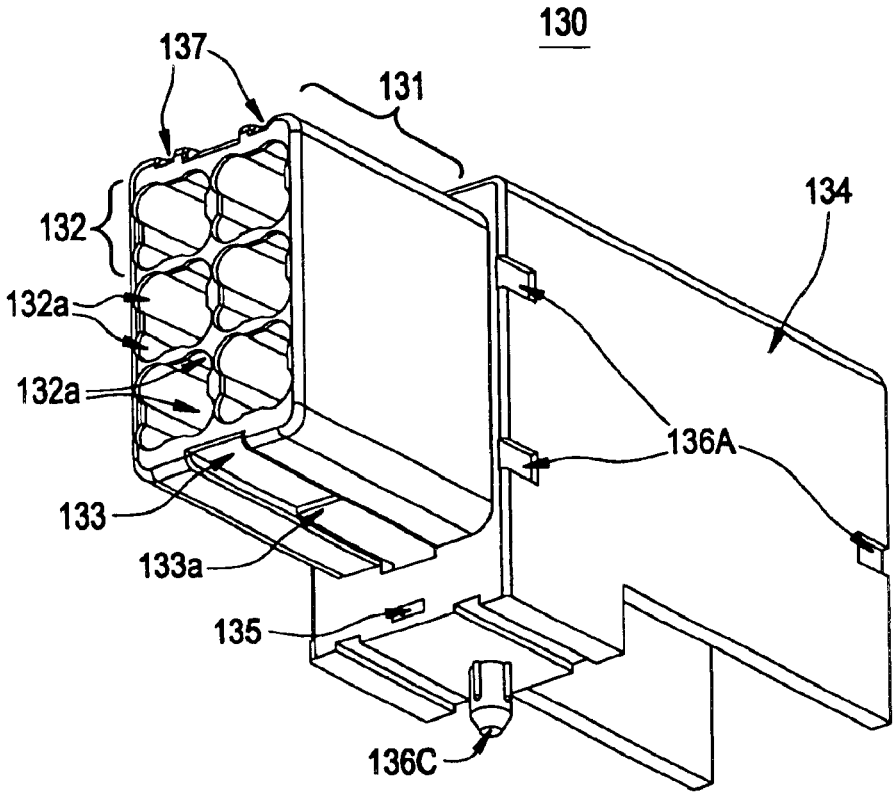
FIGS. 4A–4F illustrate perspective views of individual components of the female unit.

Referring to FIG. 4A, a female contact housing 130 comprises a unitary molded piece made of liquid crystal polymer (LCP) or other suitable electrically insulating material which exhibits little or no shrinkage during the molding process and is chemically plated with a conductive material such as a copper/nickel (Cu/Ni) alloy.

Figure 2:
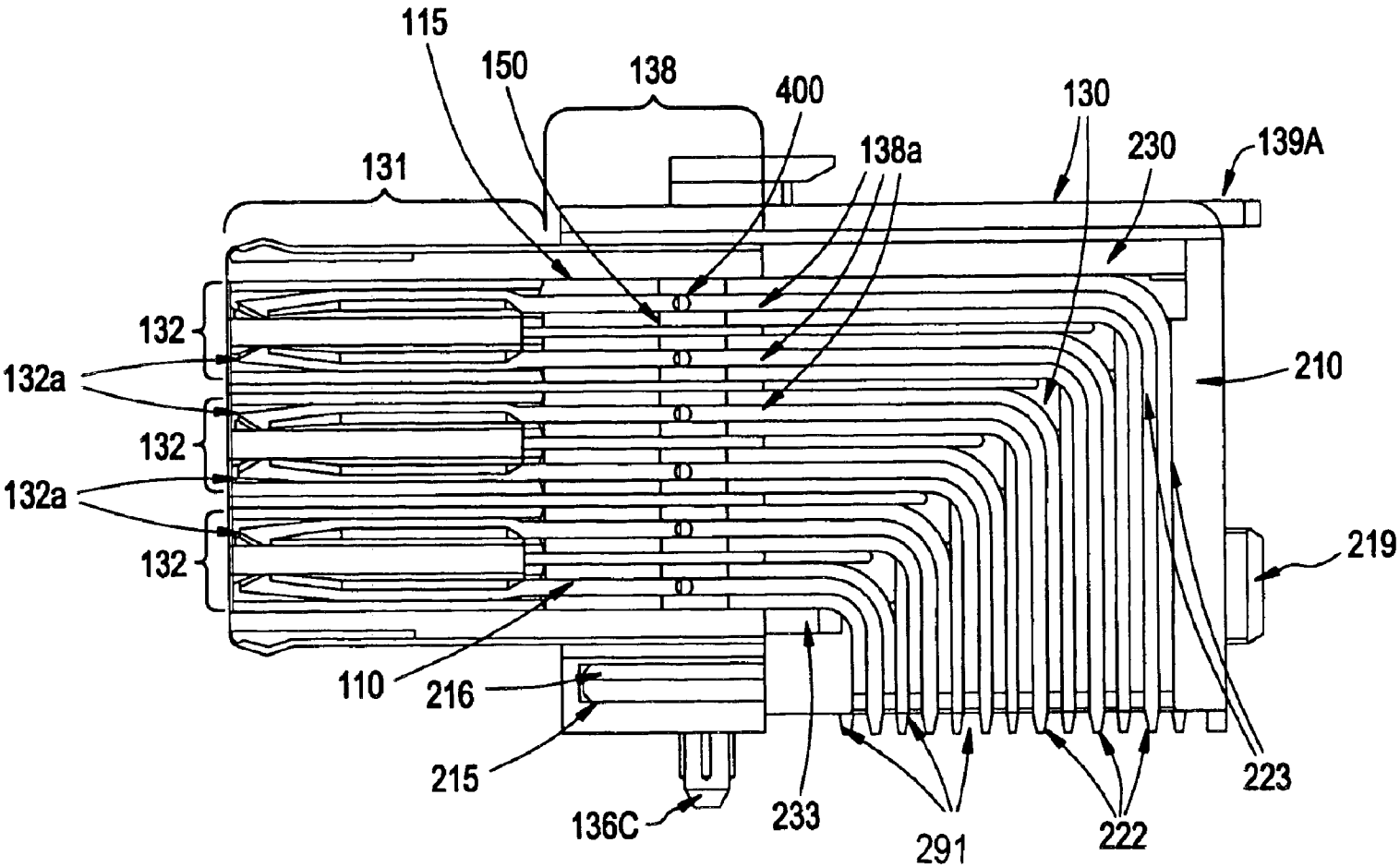
FIG. 2 illustrates a section view of the right angle modular female interconnect component assembly.

The female contact housing comprises an integrally formed female contact opening housing 131 containing a plurality of female contact openings 132 formed therein. The female contact openings terminate at the back of the female contact opening housing, and connect to female contact pin holding openings 138 (shown more clearly in FIG. 2) formed within the female contact housing. The female contact pin holding openings formed behind the female contact opening housing have a cross sectional area with a finite rotational symmetry, a portion of which, conforms to a shape of a female pin insulator which will be discussed in greater detail below. The female contact pin holding openings allow female contact pins 110 to be installed within the female contact housing.

Referring back to FIG. 4A, in one exemplary embodiment according to the principles of the present invention, the plurality of female contact openings may be arranged within rows and columns of a regular grid pattern within the female contact opening housing and include dimensions sufficient to hold a plurality of male contact structures within each of the female contact openings, as will be discussed in greater detail below. Furthermore, each of the female contact openings include a plurality of pin recesses 132*a* which accommodate female contact pins 110 and their related structures.

Found within the outer top and bottom surfaces of the female contact opening housing 131, a plurality of guide grooves 133 are formed that extend as cavities into the female housing shell behind the female interconnect housing. As will be discussed in greater detail below, these guide grooves secure subsequently provided shielding contacts which help to ground the device upon connecting to a subsequently provided male interconnect component. Shielding contact ledges 133*a* allow shielding contacts within the female interconnect component to connect to shielding contacts within the male interconnect component, as will be discussed in greater detail below. Further included within the outer top surface of the female contact opening housing, a plurality of orientation channels 137 which ensure that the female unit is oriented correctly upon a successful mating with a male unit.

Integrally formed at the insertion end 138*a* of the female contact pin holding openings 138 is a female housing shell 134 which includes two opposing side panels separated by a top panel and makes electrical contact to a subsequently provided female right angle body 210. The female housing shell includes notched slot structure 135 formed therein which extends as a specifically shaped cavity through the female housing shell 134 in the direction of a mating action between a completed female right angle unit and a completed female unit and secures to subsequently provided latching means included in the female right angle unit. Furthermore, the female housing shell also comprises a plurality of press fit pegs 136C protruding from a bottom surface thereof. The press fit pegs may be used to self align signal contacts (not shown) to respective electrical contacts on a circuit board of an electrical device.

As shown in FIG. 1A, the female housing shell 134 further includes modular alignment recesses 136A formed on an exterior of one of the side panels. Referring to FIG. 1B, the female housing shell also includes integrally formed modular alignment protrusions 136B formed on an exterior of the other of the side panels, modular frame alignment protrusions 139A, and modular frame connection means 139B. Modular alignment recesses and protrusions as well as modular frame alignment protrusions and connection means are used to connect and align any desired number of female components together, as will be discussed in greater detail below. Modular frame connection means comprises a vertical alignment fin 139C and tab 139D.

Figure 3:
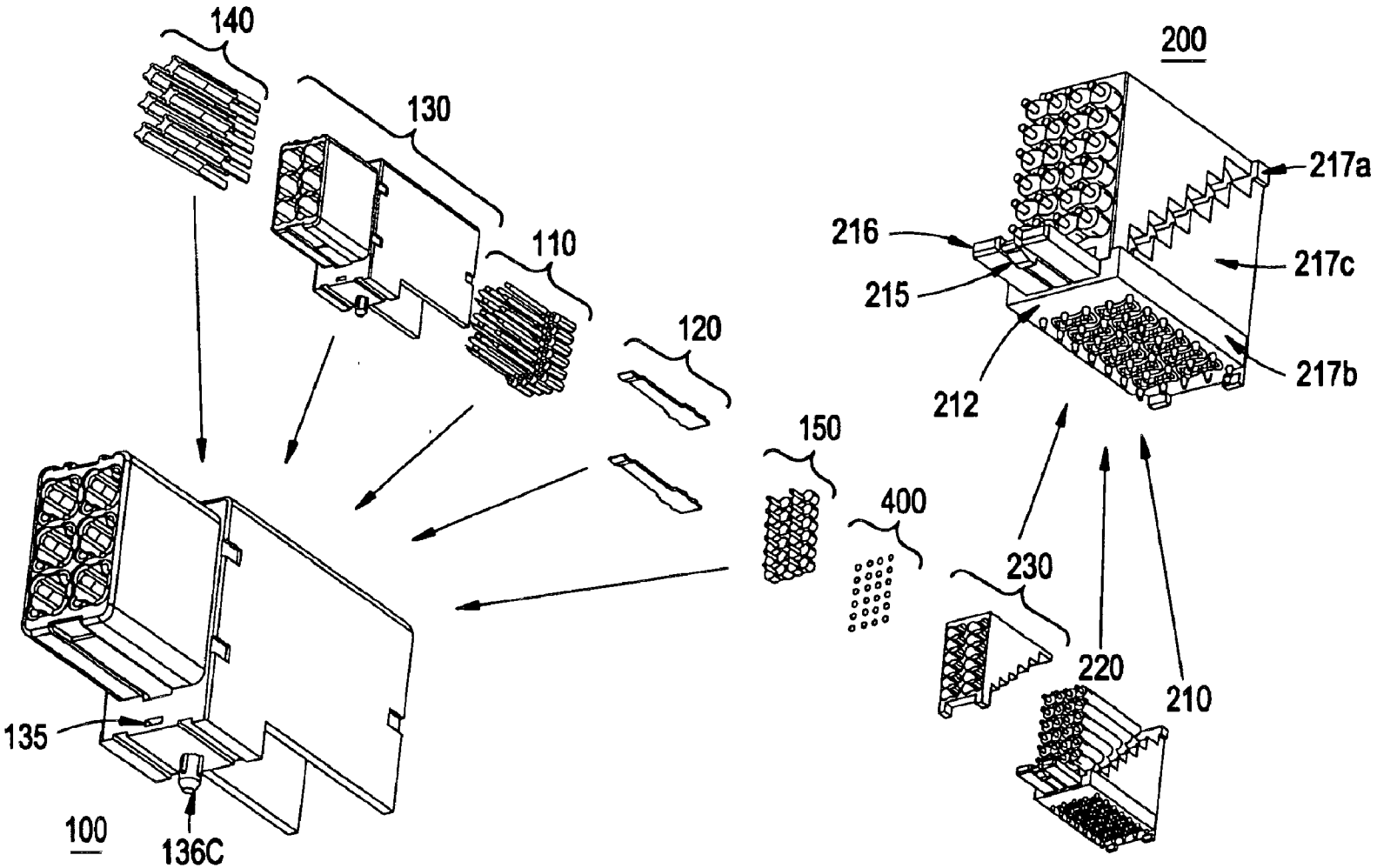
FIG. 3 illustrates an exploded view of the modular female interconnect component assembly.
Figure 4B:
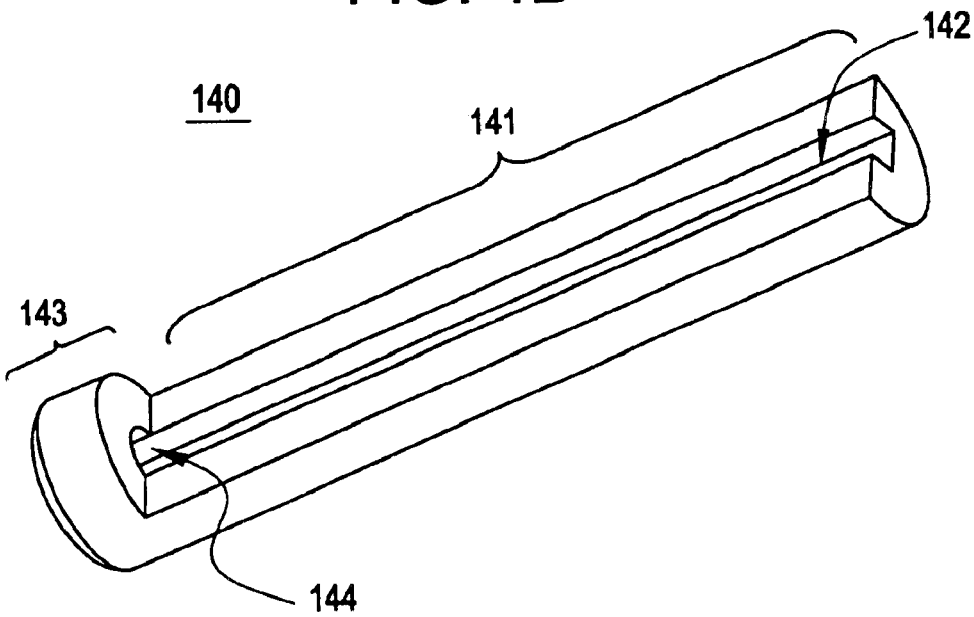

Referring to FIG. 3, in one aspect of the present embodiment, a plurality of female contact opening insulators 140 may optionally be securely provided within the pin recesses 132*a* of the female contact openings 132. Referring to FIG. 4B, the female contact opening insulators may comprise a single piece of electrically insulative material such as Teflon or other suitable insulative material which may be provided in a molded shape to electrically isolate the plurality of female contact pins 110 from the female contact housing 130.

Each female contact opening insulator is molded into a shape which comprises two sections: an elongated support section 141 for preventing the female contact pins from contacting the female contact housing upon insertion of male contact pins into the female contact openings; and an anchor portion 143 for regulating a maximum axial movement of the female contact pin 110 down the length of the elongated support section. The elongated support section includes a support groove 142, in which subsequently provided female contact pins 110 will be provided. The anchor portion 143 is located at the back end of the elongated support section and contains an anchor hole 144 that communicates with the support groove.

Figure 4C:
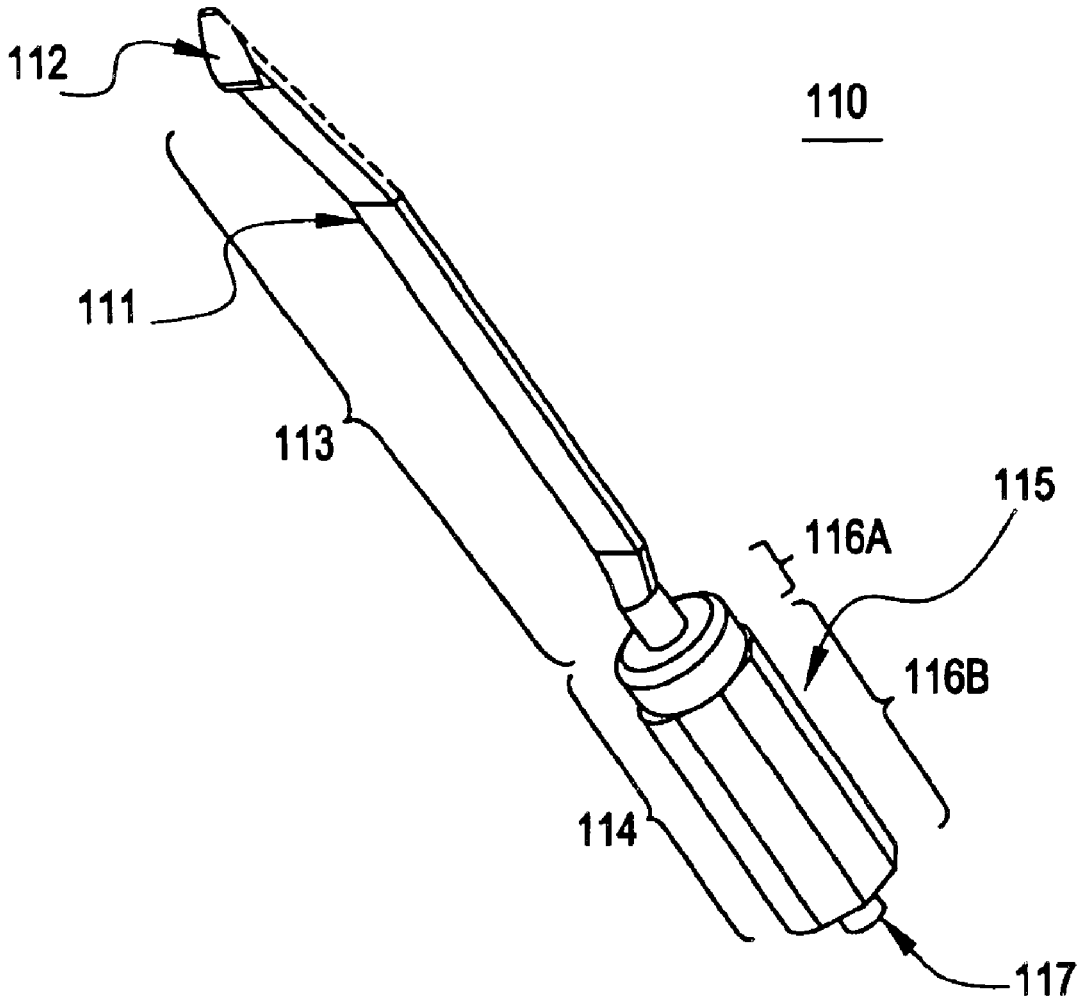
Figure 4D:
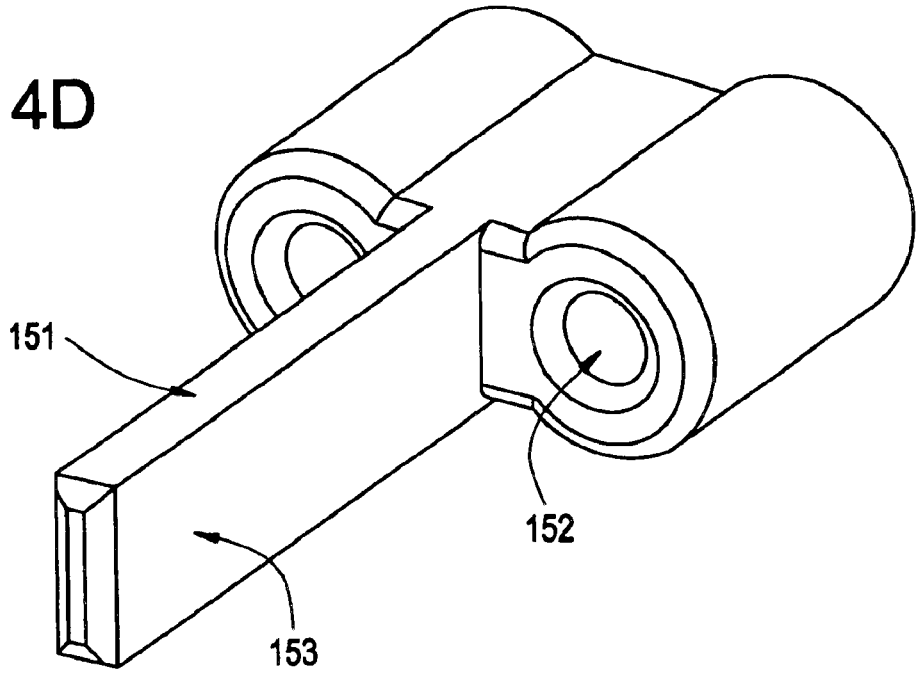

Referring to FIG. 3, pairs of female contact pins 110 are inserted through individual female contact pin holding openings 138 and into the pin recesses 132*a*. If the female contact opening insulators 140 are provided within the pin recesses 132*a*, the female contact pins 110 may be inserted through individual female contact pin holding openings 138 and into the anchor holes 144 of the female contact opening insulators 140. Upon inserting the female contact pins, the conductive receiving pins 111 shown in FIG. 4C are disposed within the pin recesses such that groups of contact portions 112 within a contact opening 132 face one toward another around an axis of the contact opening. If the female contact opening insulators 140 are provided within the pin recesses 132*a*, the conductive receiving pins 111 may be disposed within the support grooves 142 of the contact opening insulators such that group of contact portions 112 within the contact opening 132 face one toward another around the axis of the contact opening. Shown more clearly in FIG. 4C, the female contact pins comprise two basic parts: the conductive receiving pin 111 and a female pin insulator 115.

The conductive receiving pin may be formed of beryllium copper, phosphor copper, brass or other copper alloys and plated with nickel, gold, tin, palladium or an alloy of two or more of nickel, gold, tin, palladium. The conductive receiving pin may be plated on its entire surface or only on the particular portion which comes in contact with the male contact pin.

Each conductive receiving pin comprises three sections: a contact portion 112 for electrically contacting to a portion of a male contact; a beam portion 113 for providing a resilient force to the conductive receiving pin, allowing the contact portion of the conductive receiving pin to exert a contact force on a subsequently provided male contact (not shown) and thereby maintain an electrical connection; and a handling portion 114 for supporting the female pin insulator.

The female pin insulator 115 is a molded product made of Teflon or other suitable electrically insulative material having a hollow axis which allows the female pin insulator to conformably slide over the handling portion 114 of the conductive receiving pin. The female pin insulator comprises two sections 116A and 116B, each having two different exterior shapes. Cylindrical pin insulator portion 116A has an exterior shape which is circular. Faceted pin insulator portion 116B comprises radial dimensions larger than the cylindrical pin insulator portion that yield an exterior shape having a finite rotational symmetry. The exterior shape of the female pin insulator conforms to the dimensions of the female contact pin holding openings 138. The female pin insulator having the shape as described above limits the degree to which the contact portion 112 extends from the back of the contact opening housing 131 into the pin recesses 132*a*. Accordingly, it is possible to maintain uniform electrical connections electrical connections during a mating of the female and male interconnect components.

After the female pin insulator has been disposed over the handling portion 114 of the conductive receiving pin, a predetermined amount of the handling portion is left exposed by the female pin insulator and so is formed a solder connection portion 117 of the conductive receiving pin. Solder connection portions of the female contact pins are electrically connected to unique signal carrying portions of right angle signal pins within the female right angle unit via subsequently provided solder balls upon mating the female unit with a female right angle unit.

Referring to FIG. 3, female solder guides 150 formed of Teflon or other suitable insulating material are inserted into the female contact pin holding openings 138 and enclose pairs of female contact pins 110. Moreover, the female solder guides contact the female pin insulator 115 and solder connection portion 117. As shown more clearly in FIG. 4D, the female solder guides comprise a unitary molded shape having solder ball holes 152 and a female contact pin divider 151.

Upon mating the female solder guides to the female contact pins, the solder connection portions are fully inserted into the solder ball holes 152, wherein the solder ball holes are only partially filled. Accordingly, when mated to the female contact pins, the female contact pin dividers fully extend between neighboring pairs of female pin insulators. Furthermore, one of the faceted surfaces contained within the faceted pin insulator portion 116B contacts a stabilizing face 153 on the female contact pin divider and thereby prevents the conductive receiving pin from becoming undesirably displaced within the pin recesses 132*a*. By preventing the conductive receiving pin from moving, reliability when mating to male contact pins is increased.

Figure 4E:
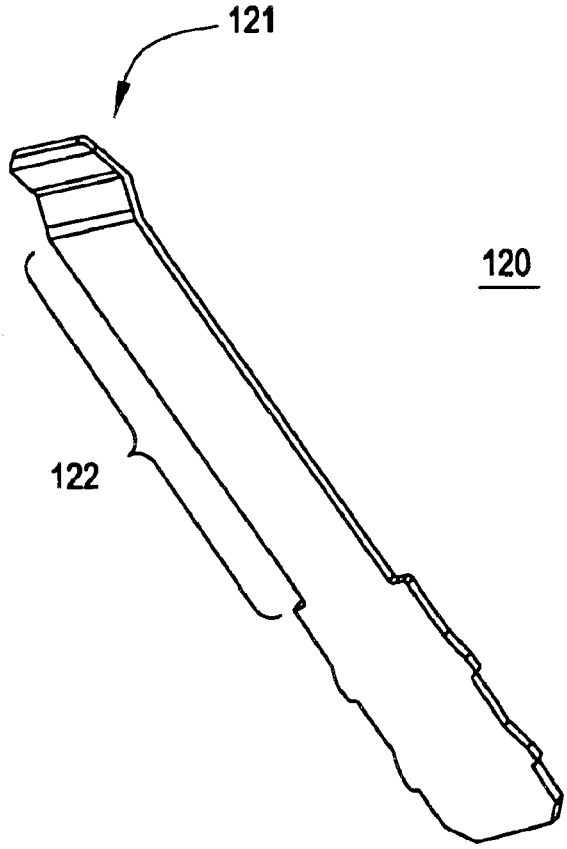
Figure 4F:
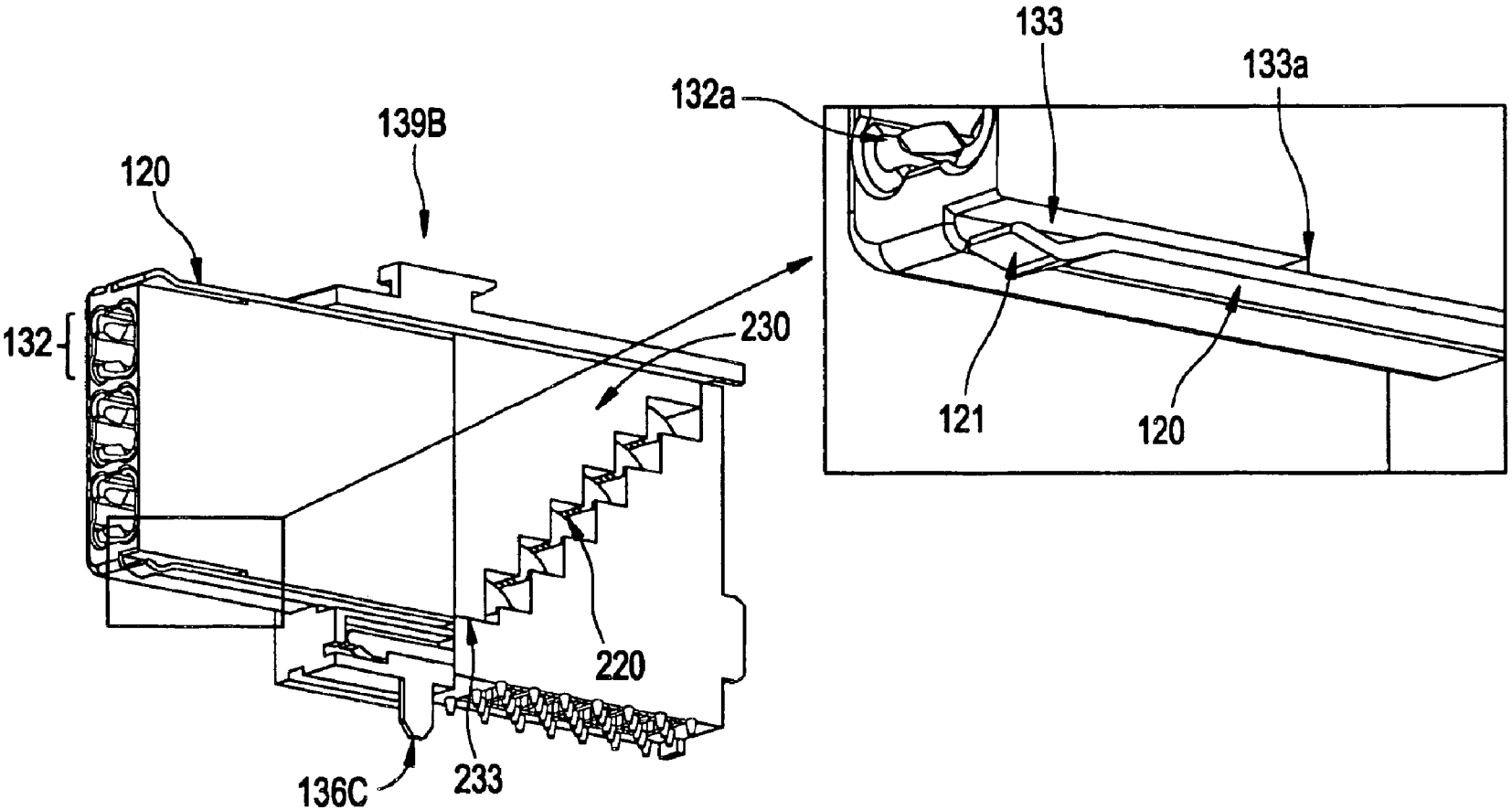

Referring to FIGS. 3 and 4F, shielding contact pins 120 formed of a phosphor bronze alloy, plated with a nickel gold alloy, and coined to increase resiliency, are provided within guide grooves 133 formed within the female contact housing and are secured within the corresponding cavities of the female housing shell 134.

Referring to FIG. 4E, shows a close up view of the shielding contact 120 within the guide groove 133 in accordance with an aspect of the present invention. As can be seen, the shielding contact is deformed to produce a contact structure 121. During mating of the female interconnect component with the male interconnect component, the contact structure 121 of the female shielding contact is initially deflected by the male shielding contact 520 and asserted to the contact portion 522 of the male shielding contact 520 using a spring force provided by a resiliency portion 122.

Thus, by assembling the female contact housing 130, the female contact pins 110, shielding contact pins 120, female solder guides 150, and optionally the female contact opening insulators 140, a female unit 100 of the female interconnect component 300 is formed.

Referring to FIGS. 3 and 5A–5E, an exploded view of the female right angle unit 200 of the modular female interconnect component 300 shown in FIG. 1 and perspective views of its individual components offers a detailed description of the female right angle unit and its manufacture.

Figure 5A:
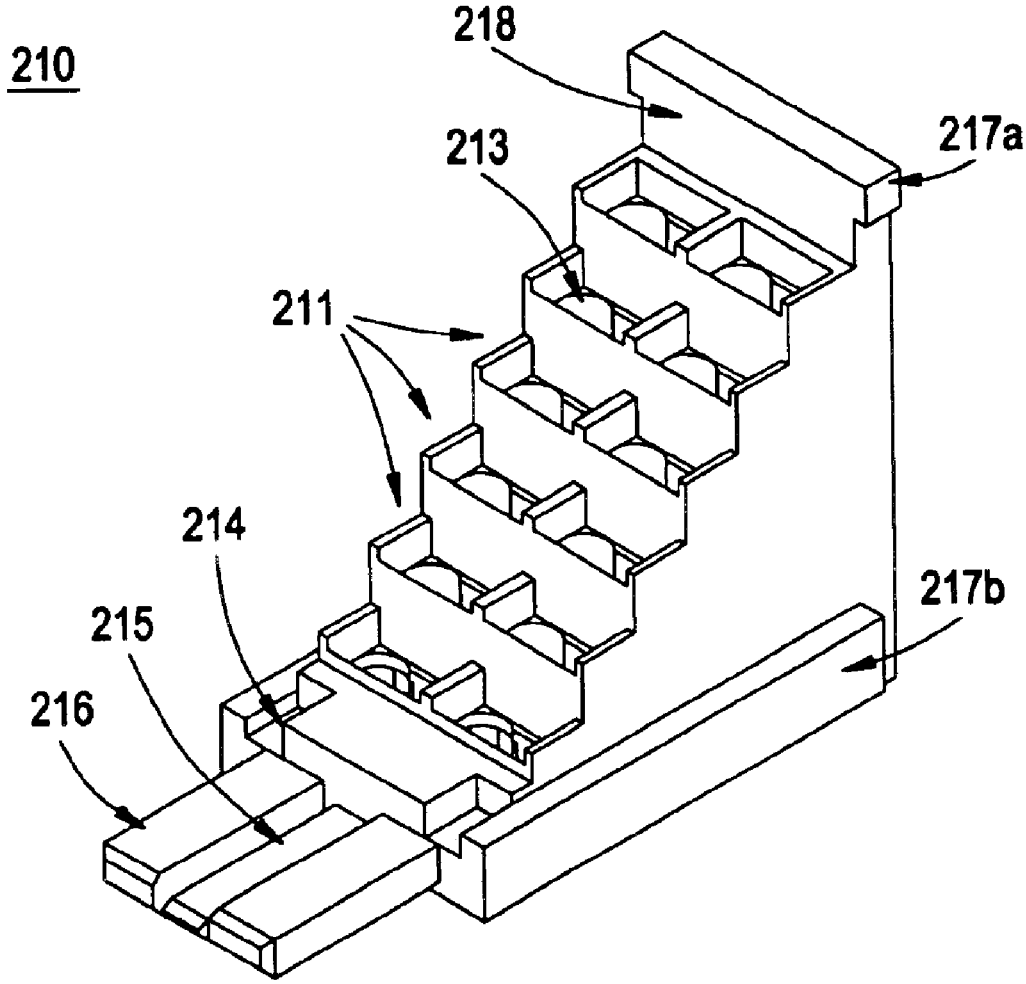
FIGS. 5A–5E illustrate perspective views of individual components of the right angle unit.

Referring to FIG. 5A, a female right angle body 210 comprises a unitary molded piece made of liquid crystal polymer (LCP) or other suitable insulating material which exhibits little or no shrinkage during the molding process and is chemically plated with a conductive material such as a Cu/Ni/Sn alloy.

The female right angle body 210 includes an upper surface comprising a plurality of stepped cascading surfaces 211, a substantially planar bottom surface 212, and a plurality of parallel signal holes 213 running through the female right angle body to the upper and lower surfaces. Each of the plurality of stepped surfaces in the upper surface includes one row of signal holes. The dimensions of signal holes are chosen such that the right angle signal pins may be securely inserted within the signal holes. The signal holes are arranged in a predetermined pattern that allows subsequently provided right angle signal pins to interface with contacts on a printed circuit board.

Further, the female right angle body 210 includes alignment guide grooves 214 the base of which are located below the stepped surface containing the shortest signal holes.

Female right angle body 210 also includes a plurality of latching means 215 wherein each latching means is surrounded on its lateral sides by stabilizing pegs 216. As shown more clearly in FIG. 5E, upon mating the female unit to the female right angle unit, the latching means 215 integrally formed with the female right angle body are inserted into the notched slot structure 135 of the female contact housing to thereby secure the female right angle unit to the female unit. The stabilizing pegs 216 are dimensioned to conform to the notched slot structure such that, when inserted within the notched slot structure simultaneously with the latching means, external forces do not adversely affect the structural integrity of the connection between the latching means and the female right angle body proper.

The female right angle body further includes housing stabilizer structures 217A and B and an upper stabilizing face 218. Upon mating the female unit to the female right angle unit, the housing stabilizer structures contact to integrally formed unit alignment means (not shown) formed on the inside of the female housing shell 134. The unit alignment means extend parallel to a direction of a mating action between the female right angle unit and the female unit and are located on the inside of the female housing shell such that the unit alignment means are inserted, in the direction of the mating action, between housing stabilizer structures 217A and 217B. Accordingly, the housing stabilizer structures increase the mechanical rigidity of the female interconnect component.

Referring to FIG. 1B, right angle body 210 further includes modular frame rotational alignment protrusions 219. Modular frame rotational alignment protrusions are formed on a back surface of the right angle body and prevent the modular female interconnect component 300 from rotating about a pivot formed at an interface between a modular frame and the modular frame alignment protrusions 139A and connection means 139B, as will be discussed in greater detail below.

Referring to FIG. 3 right angle signal pins 220 are inserted into the signal holes 213 of the female right angle body 210. Right angle signal pins provided within the rows of signal holes found in any given stepped surface of female right angle body 210 are of equal length. However, the overall length of the right angle signal pins vary from row to row to ensure the right angle signal pins extend a uniform distance from the bottom surface 212 of the female right angle body and extend a uniform distance from a mating surface of right angle pin guide 230, as will be discussed in greater detail below.

Figure 5B:
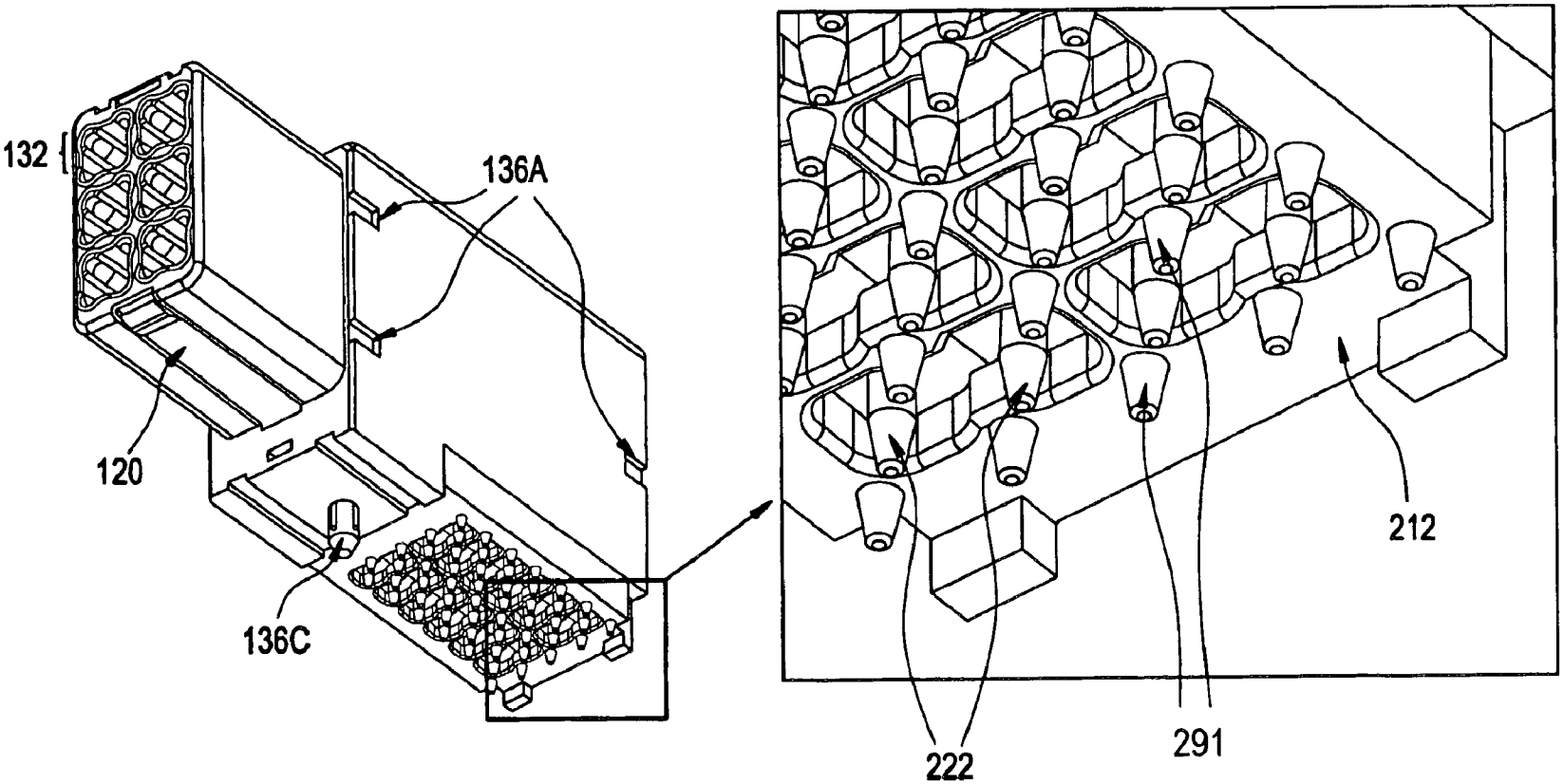
Figure 5C:
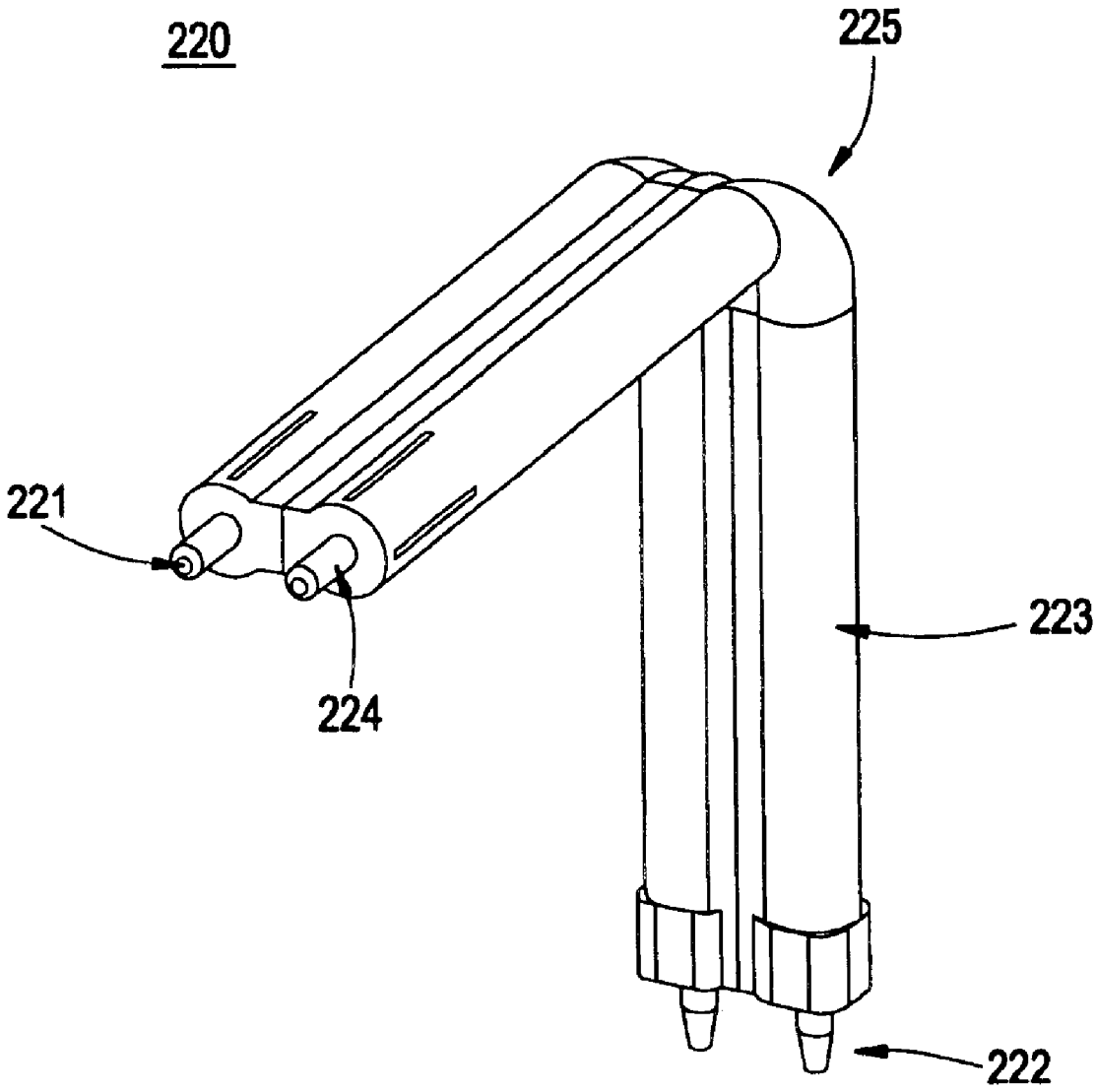
Figure 5D:
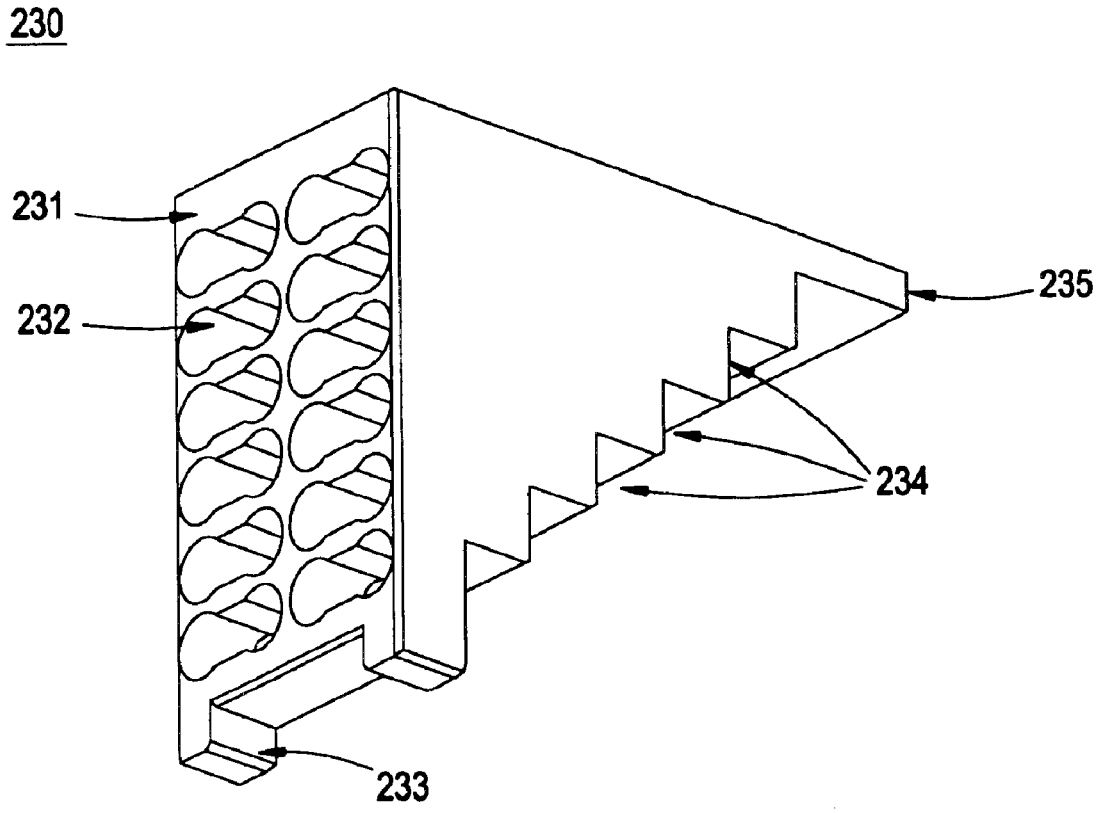
Figure 5E:
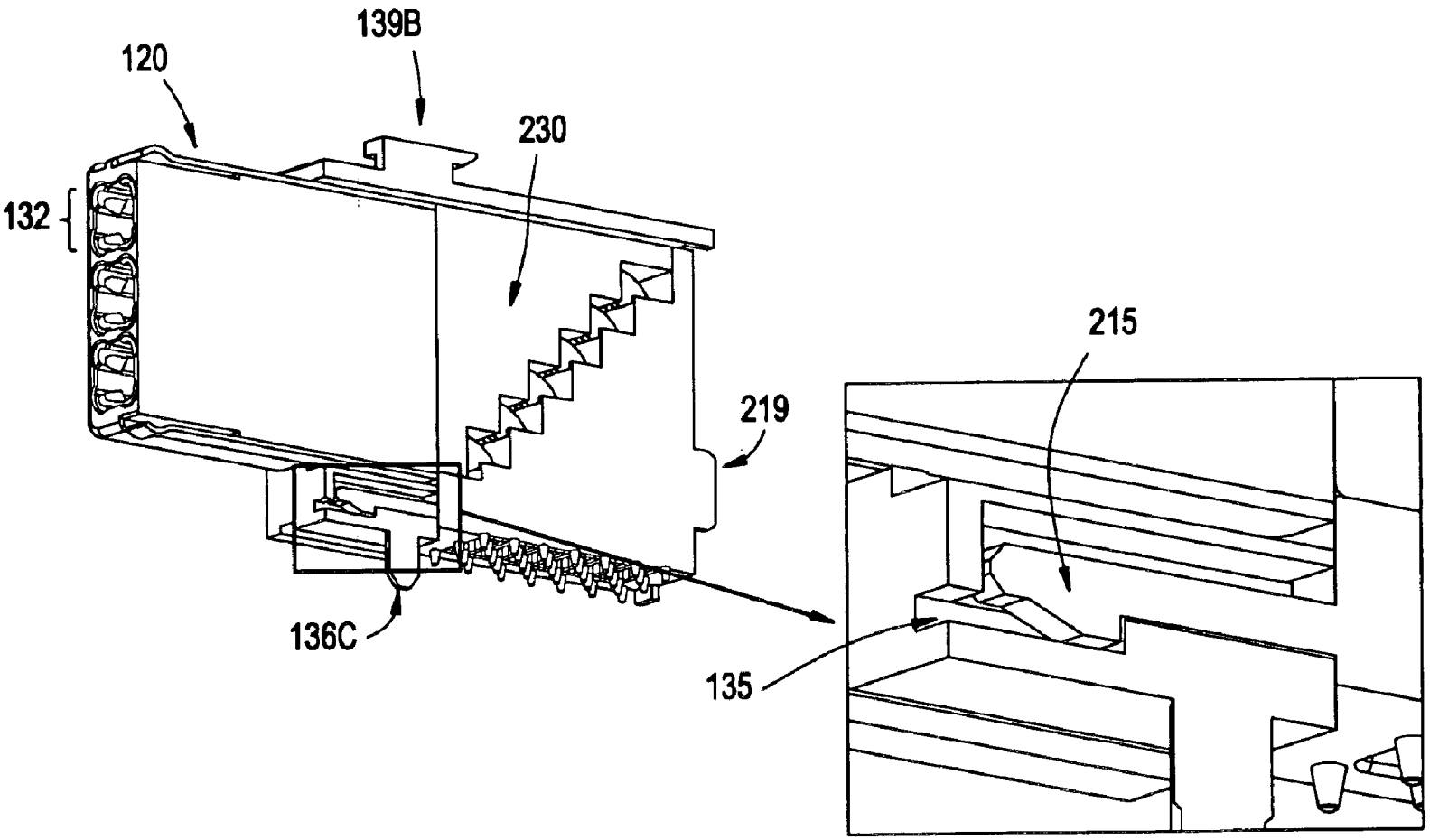

Referring to FIG. 5C, the signal carrying portion of the right angle signal pins 220 comprises a wire 224 made from a beryllium copper, phosphor copper, brass or other copper alloys and plated with nickel, gold, tin, palladium or an alloy of two or more of nickel, gold, tin, palladium, and bent at angle location 225. The right angle signal pins also include signal pin shielding insulators 223 comprising Teflon coated with a conductive material such as a plated Cu/Ni/Sn alloy or aluminum, which surrounds the wire. The ends of the wire include ends for an interconnect signal connection 221 and a board signal connection 222. The plurality of right angle signal pins are arranged in a pattern which provides the interconnect signal end in a pattern corresponding to the pattern of the solder connection ends 117 in the female unit 100.

As shown in FIG. 5C, the right angle signal pins 220 are provided, in accord with one aspect of the invention, as a differential pair, wherein pairs of wires 224 are enclosed within a single shielding insulator 223 having binocular shaped dimensions. However, the differential shielding insulator may alternatively comprise any of a plurality of shapes such as a block, an hourglass, or the like and may enclose a single right angle signal pin. Regardless of the shape of the shielding insulator used, the cross sectional dimensions of the signal holes must correspond to the cross sectional dimensions of the right angle signal pin so that the signal hole conforms to the right angle signal pin.

Referring to FIG. 5B, the bottom surface 212 of the female right angle body 210 further comprises integrally formed ground bumps 291. The ground bumps are provided in any pattern as necessitated by the contact interface of a PCB (not shown) so as to contact to corresponding ground signal contacts on the printed circuit board. In one aspect of the present invention, ground bumps may be arranged on the bottom surface 212 such that such that adjacent ground bumps are provided approximately 1.5 mm apart, wherein board signal connection ends 222 are centered within a region defined by four ground bumps. Such an arrangement is heretofore called an eight pin cluster and provides a differential impedance of approximately 100 Ω, exhibits good anti-symmetric properties. As in the female right angle body proper 210, ground bumps are also metallized and protrude from the bottom surface 212 the same distance as the board signal connection end 222 of the right angle single pin 220 thereby ensuring good signal isolation and confinement.

Figure 12:
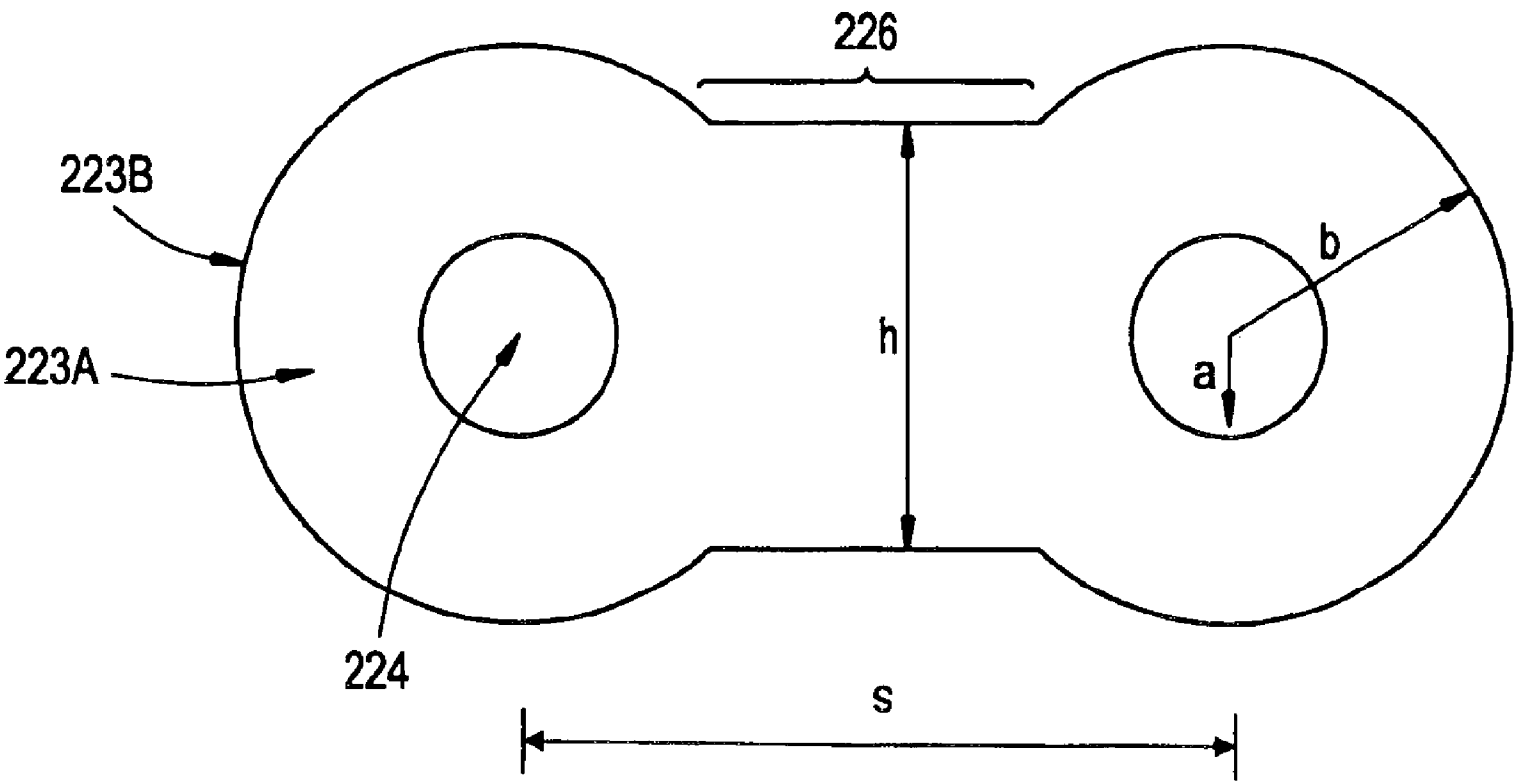
FIG. 12 illustrates dimensions of a differential shielding insulator according to one aspect of the present invention.

Referring now to FIG. 12, a cross sectional view of the right angle signal pins is shown. According to one aspect of the present invention, a centerline distance, s, between adjacent wires 224 in a differential pair of an eight pin cluster, and in neighboring differential pairs, is approximately 1.5 mm. The radius, a, of the wire is approximately 0.39 mm. The shielding insulator 223 having binocular shaped dimensions includes the right angle insulator 223A made of an electrically insulating material, i.e., Teflon coated by an angle shielding structure 223B made of a conductive material, i.e., aluminum or a Cu/Ni/Sn alloy. The thickness of the right angle shielding structure is approximately 20 $\mu$m. The radius, b, of the right angle insulator must be chosen so as to provide for easy connection between the right angle shielding structure and board ground pins upon connection of the female interconnect component to a PCB and at the same time allow for spacing between itself and neighboring differential pairs for electrical shielding considerations and mechanical support. The radius, b, in one aspect of the invention may be approximately 0.7 mm. Additionally, the dimensions of the right angle insulator radius, b, as well as the height, h, of the differential spacer portion 226 comprising the portion of the shielding insulator located between wires 224 of the differential pair, must be optimized to maintain an impedance match between the right angle signal pins and the PCB connector pins at the interconnect component/PCB interface. The height, h, in one aspect of the invention may be approximately 0.9 mm.

Referring now back to FIG. 3, an angle pin guide 230 is positioned proximate the female right angle body 210 having the right angle signal pins 220 inserted therein. As shown more clearly in FIG. 5D, an angle pin guide 230 comprises a unitary molded block of material made of liquid crystal polymer (LCP) or other suitable insulating material which exhibits little or no shrinkage during the molding process.

The right angle pin guide includes a back surface comprising a plurality of stepped cascading surfaces 234, a substantially planar mating surface 231, and a plurality of parallel guide holes 232 running through the right angle pin guide to the female unit interface surface and the back surface. Each of the plurality of stepped surfaces in the back surface of the right angle pin guide includes one row of guide holes. The guide holes 232 are arranged in number and pattern to correspond to number and pattern of the right angle signal pins 220. The dimensions of the guide holes are chosen such that the right angle signal pins 220 may be securely inserted therein upon placing the right angle pin guide proximate the female right angle body 210 having the right angle signal pins 220 inserted therein.

The right angle pin guide further includes lower and upper stabilizing projections 233 and 235, respectively. Upon insertion of the seated right angle signal pins into the guide holes, the lower stabilizing projection 233 is simultaneously inserted into the alignment guide grooves 214 of the female right angle body and the upper stabilizing projection 235 abuts the upper stabilizing face 218 of the female right angle body. Accordingly, the upper and lower stabilizing projections fix a lateral and angular movement of the right angle signal pins and ensures that portions of the right angle single pins not inserted within the female right angle body are parallel. Lastly, upon insertion of the right angle signal pins into the guide holes, the stepped surfaces 234 on the back surface of the right angle pin guide are slid over the right angle signal pins to the angle 225 thereby protecting the angle 225 from external objects.

Thus, in assembling the female right angle body 210, the right angle signal pins 220, and the right angle pin guide 230, a female right angle unit 200 of the modular female interconnect component 300 is formed.

The modular female interconnect component 300 is formed by electrically and mechanically mating the female right angle unit and the female unit to each other. According to one aspect of the invention, while referring to FIG. 3, a plurality of solder balls 400 are interposed between the solder connection portions 117 within the female unit 100 and the wires 224. More specifically, the solder balls are disposed within the solder ball holes 152, such that they contact the solder connection portions of the female contact pins, and the interconnect signal connection ends of the right angle signal pins are then inserted into the solder ball holes to contact the solder balls. Accordingly, each of the plurality of female contact pins is electrically and mechanically connected to a unique wire within an angle signal pin.

Figure 6A:
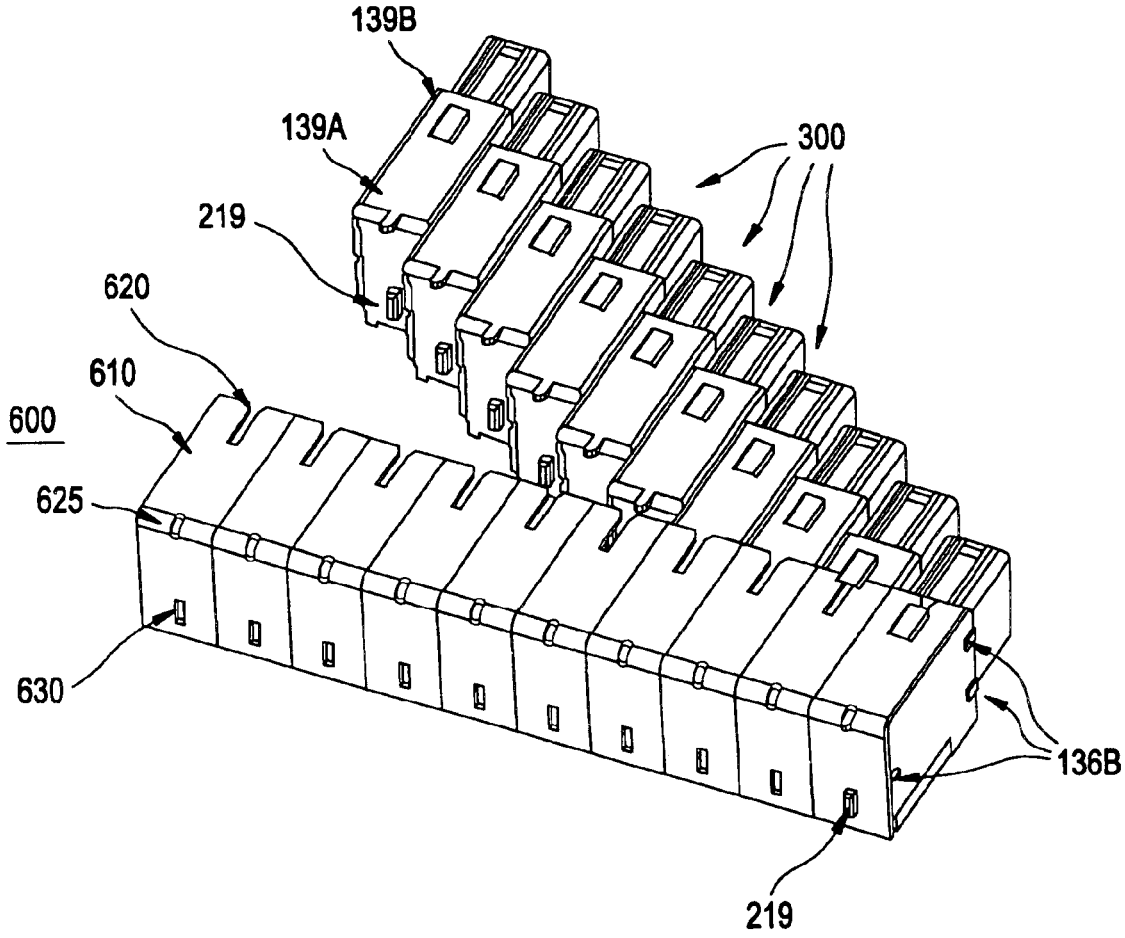
FIGS. 6A–6C illustrate perspective views of a plurality of modular female interconnect components assembled in a modular frame.
Figure 6B:
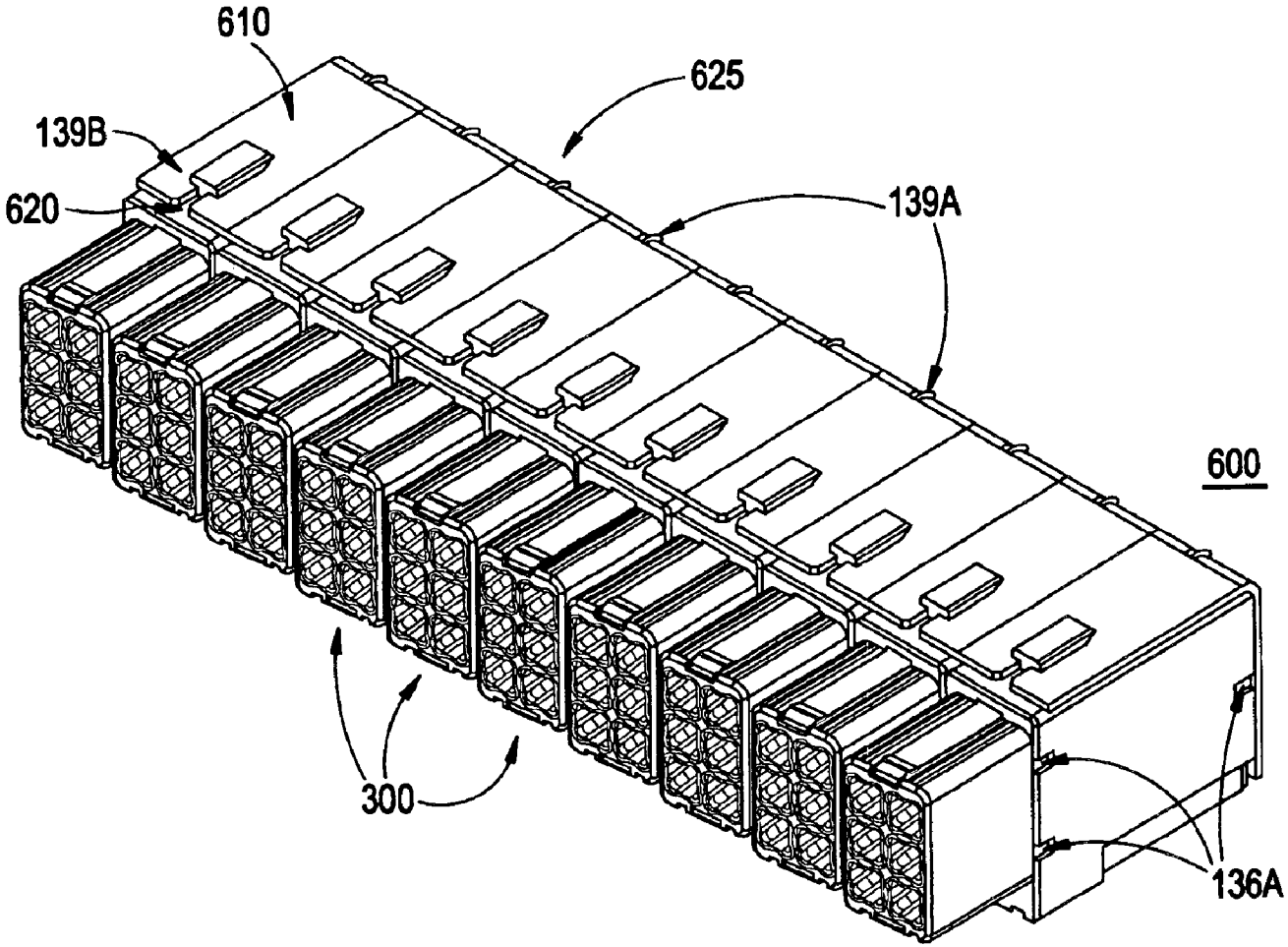
Figure 6C:
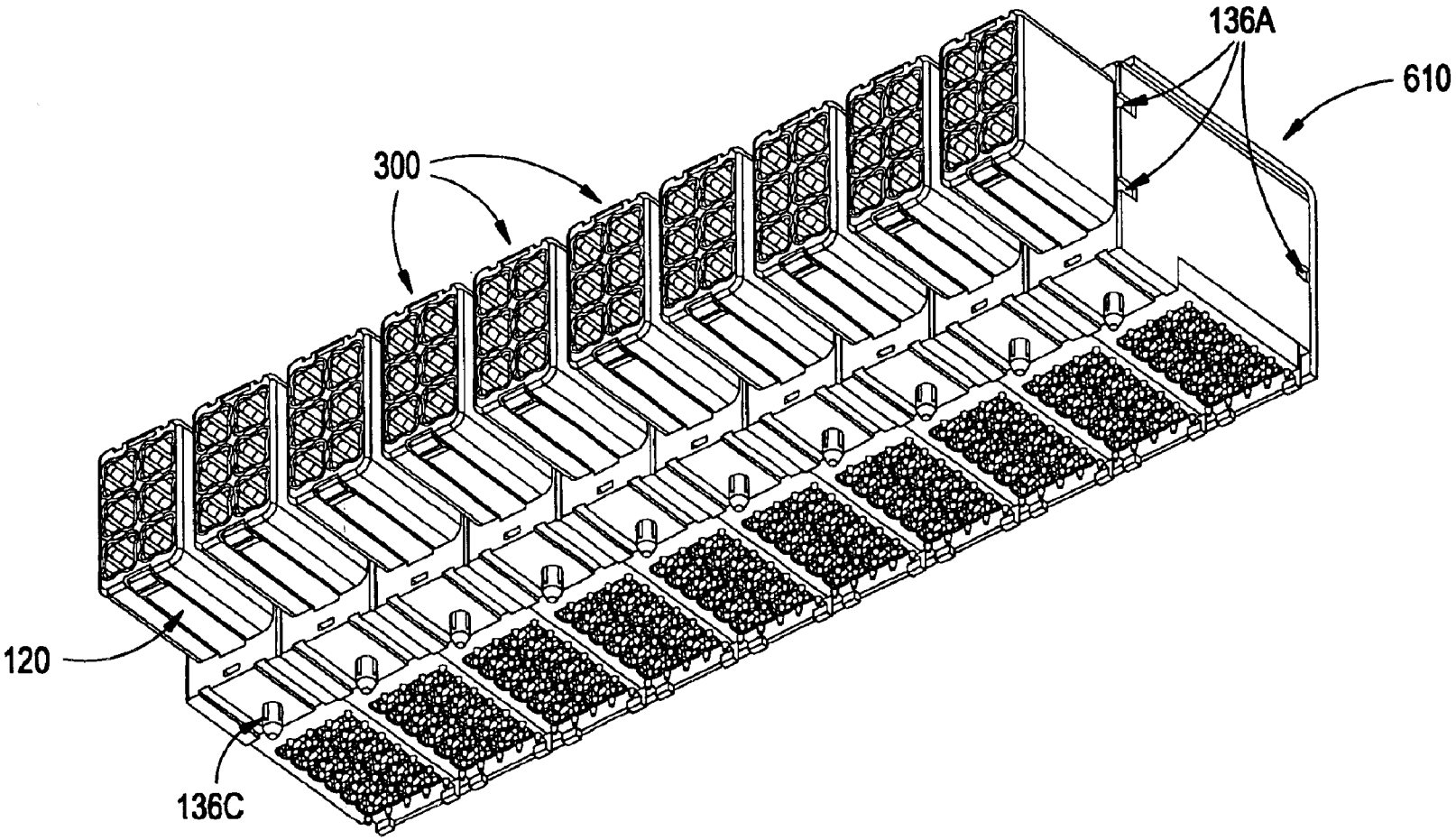

Referring now to FIGS. 6A–6C, a plurality of modular female interconnect components 300 are connected to each other via a female modular frame 600. The female modular frame may be formed of stainless steel or other suitable material.

As shown in FIG. 6A, the female modular frame comprises a single, deformed plate 610, bent at 90°. Within the deformed plate, holes are cut or punched as is well known in the art. More specifically, frame connection hole 620 is adapted to receive the vertical alignment fin 139C and has a width less than a width of tab 139D. Accordingly, the frame connection hole allows the frame connection means 139B to slide thereinto and thereby fix a vertical movement of the modular female interconnect component. Frame alignment hole 625 is formed within the bent portion of the deformed plate and is configured to receive the modular frame protrusions 139A and thereby prevents the modular female interconnect component from a displacement within the female modular frame. Vertical frame alignment hole 630 is formed to receive the modular frame rotational alignment protrusions 219 and thereby further prevents the modular female interconnect component from a displacement within the female modular frame.

Referring to FIG. 6A, upon inserting the modular female interconnect components 300, with their respective alignment mechanisms, into the female modular frame 600, modular alignment protrusions 136B found on one modular female interconnect component are fully inserted into modular alignment recesses 136A found in neighboring adjacent modular female interconnect components. By maintaining mated modular alignment protrusions with corresponding recesses, the plurality of female contact pins 110, right angle pins, and ground bumps within the modular female interconnect components are aligned as shown in FIGS. 6B and 6C, respectively. Consequently, successful mating to modular male interconnect components and connecting to signal contacts in PCBs may be achieved.

Figure 7A:
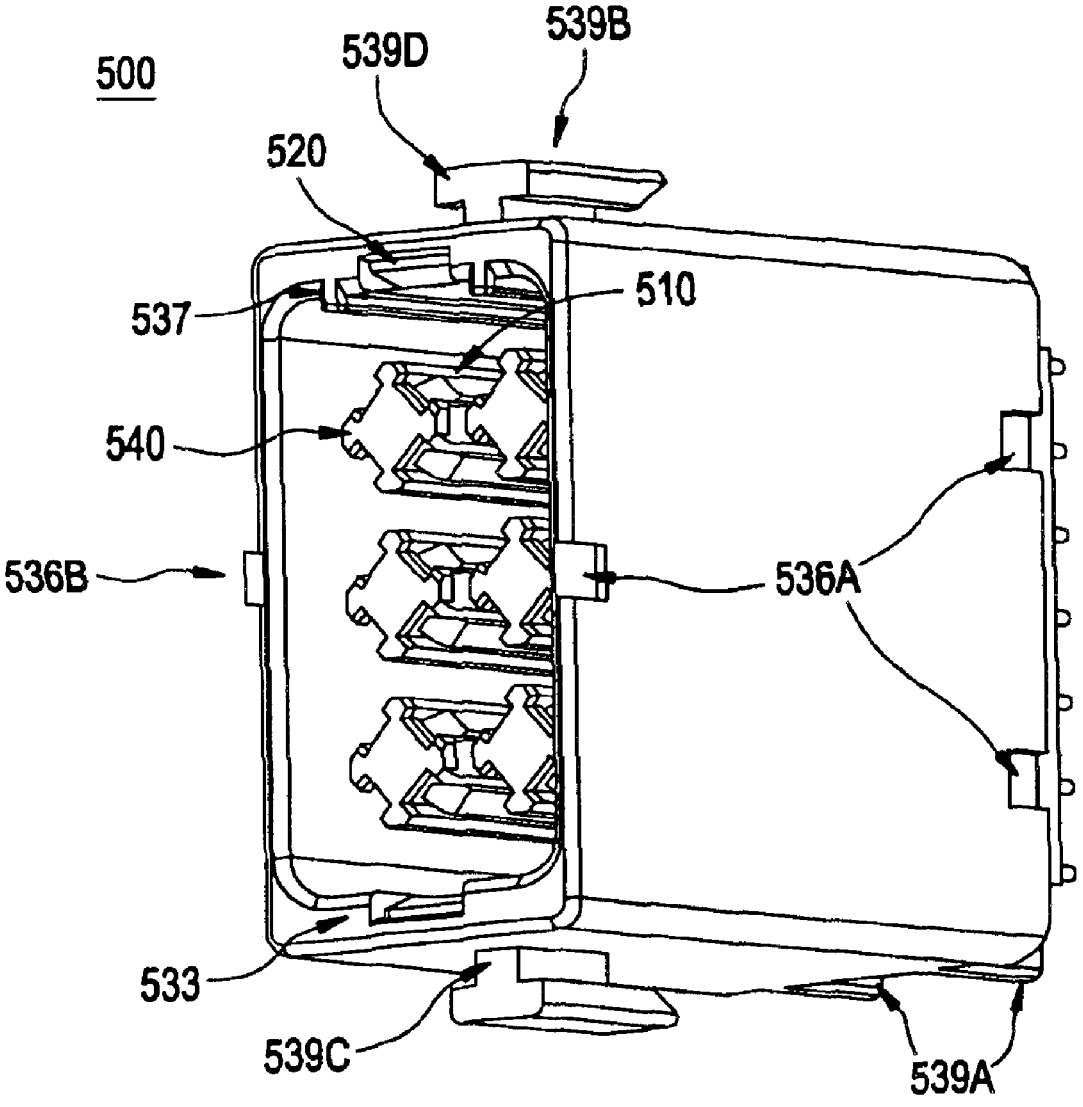
FIGS. 7A and 7B illustrates a perspective front and back views of the modular male interconnect component in accordance with the principles of the present invention.
Figure 7B:
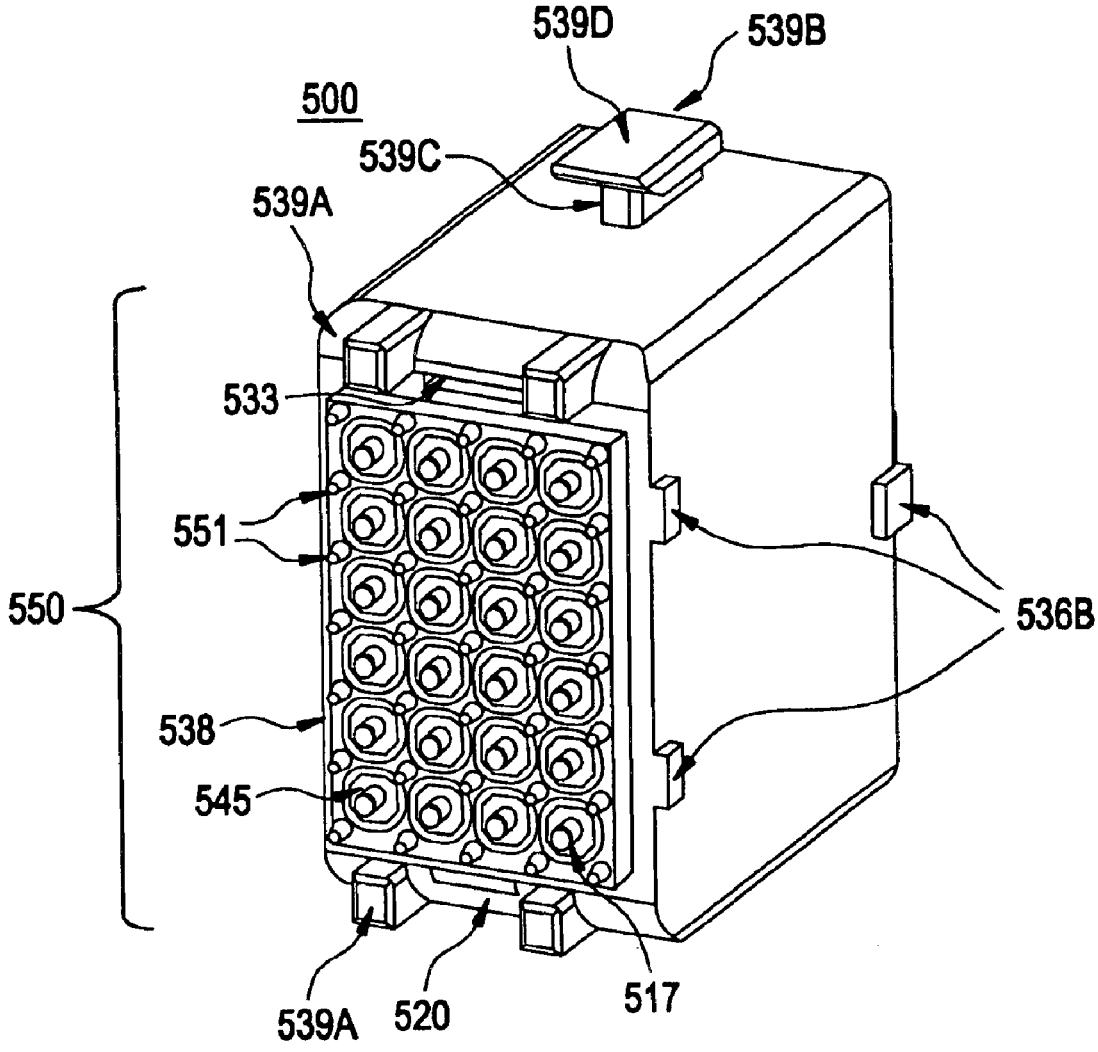

Referring to FIGS. 8 and 9A–9E, an exploded view of the male interconnect component 500 shown in FIGS. 7A and 7B and perspective views of its individual components offers a detailed description of the modular male interconnect component and its manufacture.

Figure 9A:
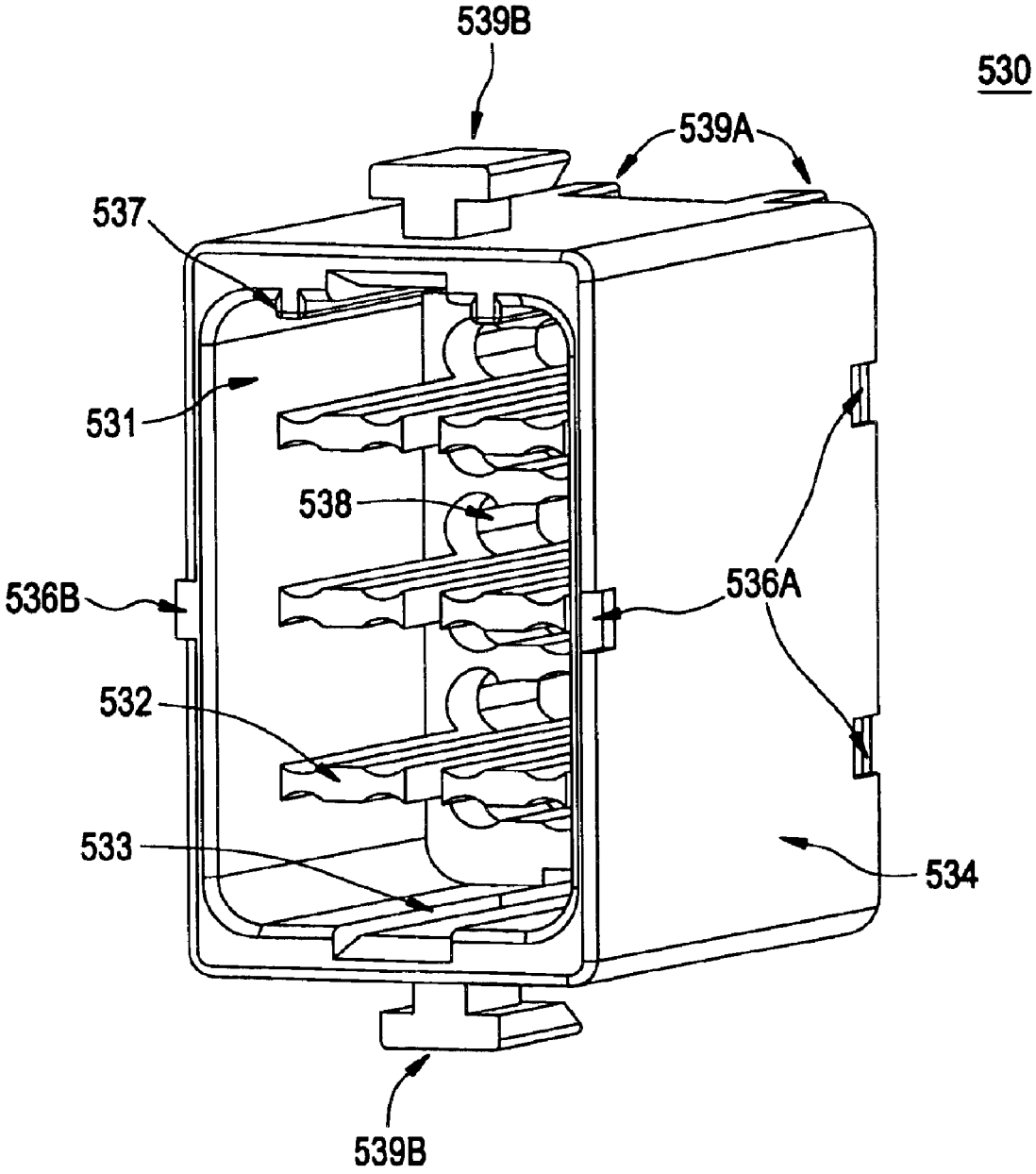
FIGS. 9A–9E illustrate perspective views of individual components of the modular male interconnect component.

Referring to FIG. 9A, a male contact housing 530 comprises a unitary molded piece made of liquid crystal polymer (LCP) or other suitable insulating material which exhibits little or no shrinkage during the molding process and is chemically plated with a conductive material such as a copper/nickel (Cu/Ni) alloy.

The male contact housing comprises an integrally formed male fin housing 531 which includes a plurality of male fins 532 formed therein. In one exemplary embodiment according to the principles of the present invention, the plurality of male fins may be arranged in a regular grid pattern containing rows and columns within the male fin housing.

Furthermore, each of the male fins 532 is formed generally as a prism having diametrically opposing major surfaces which are not flat. This prism shape prevents any undesirable lateral and rotational motion of a subsequently provided male fin insulator 540 from occurring.

Behind each of the male fins, at the back of the male fin housing, a plurality of male contact pin holding openings 538 are provided within the male contact housing which allow male contact pins 510 to be installed within the male contact housing. The male contact pin holding openings formed behind the male fins have a cross sectional area with a finite rotational symmetry, a portion of which, conforms to a shape of a male pin insulator which will be discussed in greater detail below.

Found within the inner top and bottom surfaces of the male fin housing 531, a plurality of guide grooves 533 are formed that extend as cavities to the back of the male fin housing. As will be discussed later, these guide grooves secure subsequently provided shielding contacts which help to ground the device upon connecting to a subsequently provided female interconnect component. Further included within the inner top surface of the male fin housing, a plurality of orientation keys 537 which ensure that the modular male interconnect component is oriented correctly upon a successful mating with a female unit of a modular female interconnect component.

Referring to FIGS. 7A and 7B, the male contact housing further comprises, integrally formed with the male fin housing 531, two opposing side panels separated by two opposing top and bottom panels as well as a back panel.

As shown in FIG. 7A, the male contact housing 530 further includes modular alignment recesses 536A formed on an exterior of one of the side panels. Referring to FIG. 7B, the male housing shell also includes integrally formed modular alignment protrusions 536B formed on an exterior of the other of the side panels, modular frame alignment protrusions 539A, and modular frame connection means 539B. Modular alignment recesses and protrusions as well as modular frame alignment protrusions and connection means are used to connect and align any desired number of male components together, as will be discussed in greater detail below. Modular frame connection means comprises vertical alignment fins 539C and tabs 539D.

As further shown in FIG. 7B, the back panel of the male contact housing 530 includes an integrally formed PCB connection stage 550 protruding from the back panel. The PCB connection stage comprises the insertion end of the male contact pin holding openings 538 and integrally formed ground bumps 551. Solder connection portions 517 of the male contact pins protrude from a major surface of the PCB connection stage the same distance as do the ground bumps such that the signal carrying and grounding protrusions form the aforementioned eight pin cluster.

Figure 8:
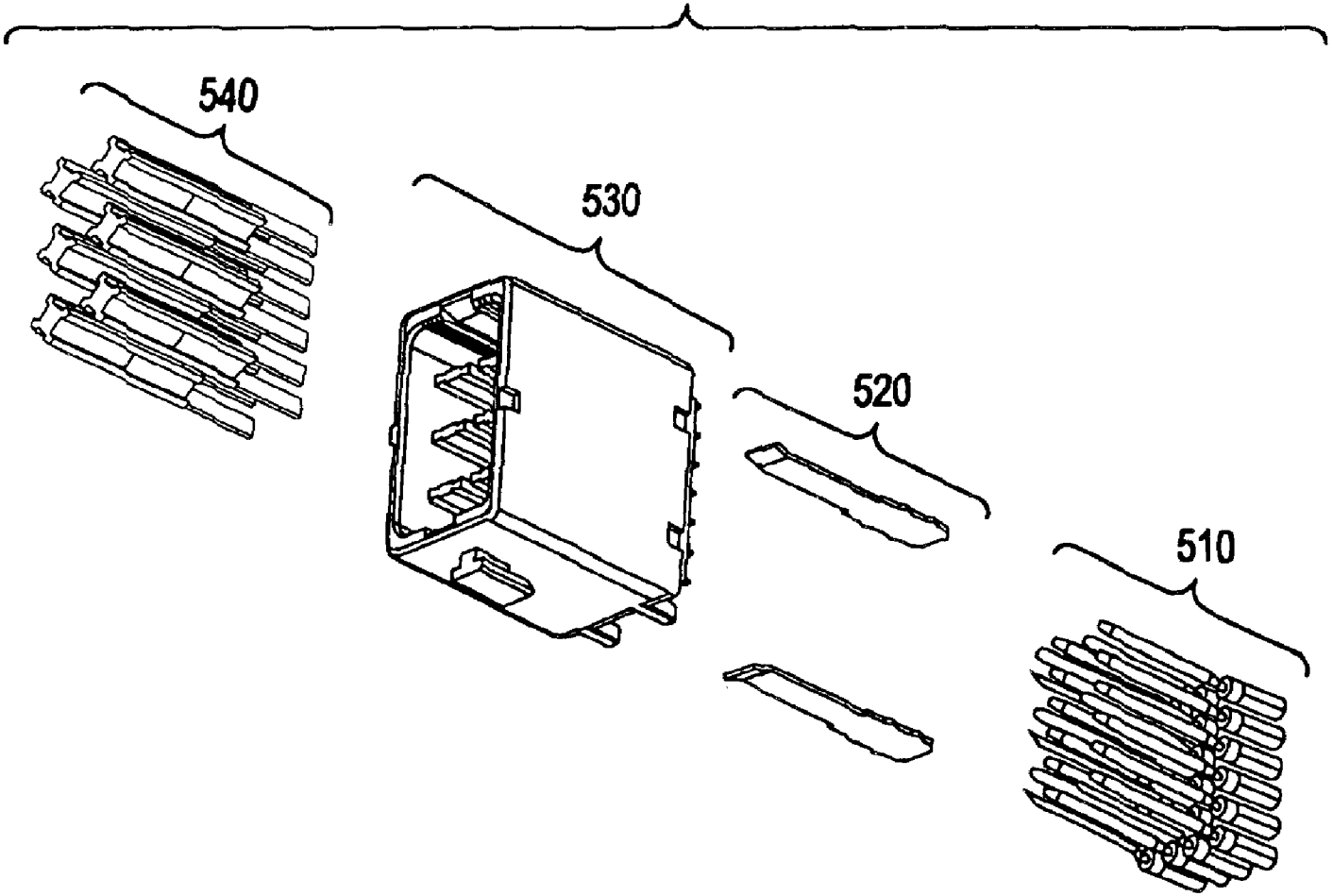
FIG. 8 illustrates an exploded view of the modular male interconnect component.
Figure 9B:
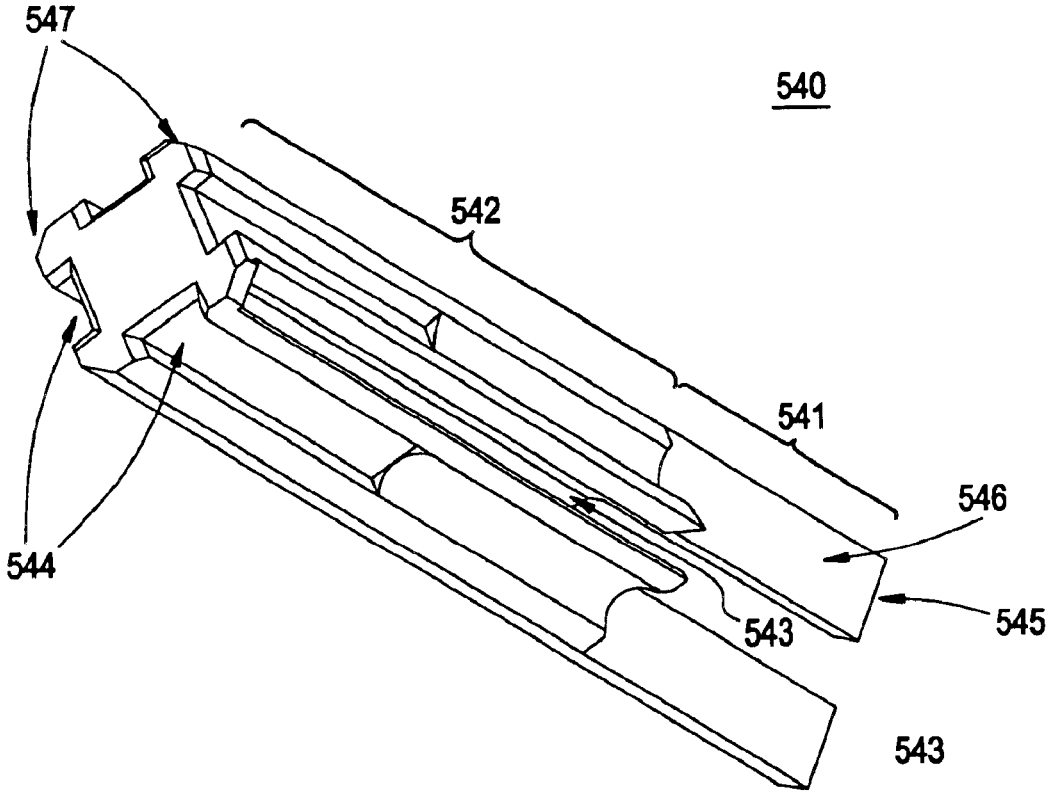
Figure 9C:
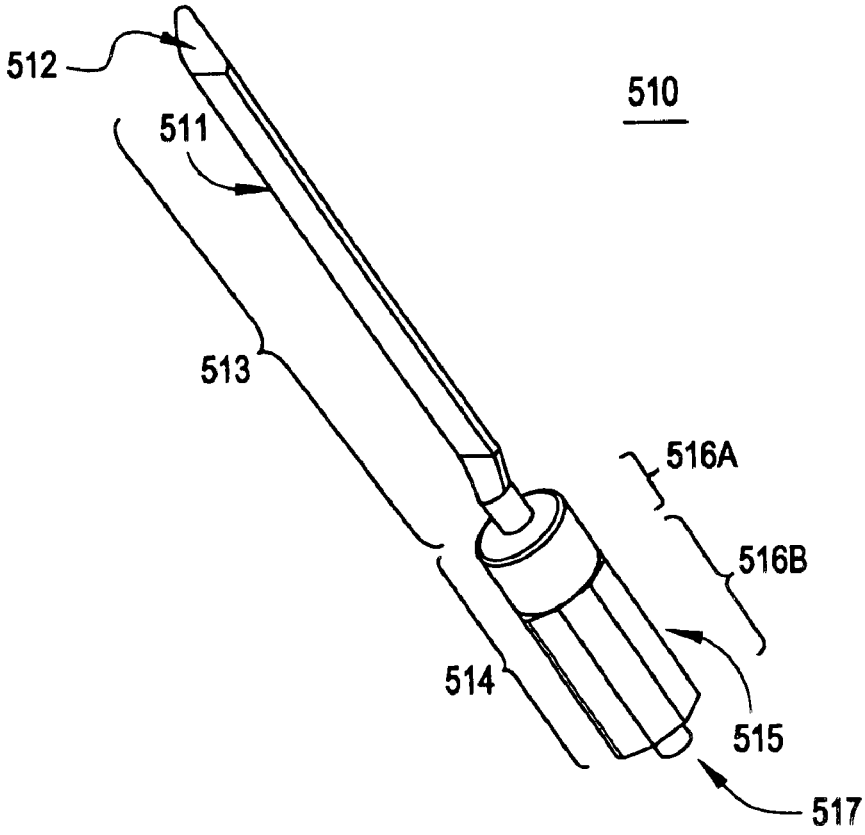

Referring to FIG. 8, a plurality of male fin insulators 540 are provided over the male fins 532. Referring to FIG. 9B, the male fin insulators 540 are unitary molded structures formed of an electrically insulative, high temperature material such as Teflon or other suitable insulative material which may be provided in a molded shape to electrically isolate the plurality of male contact pins 510 from the male fins 532.

Each male fin insulator is molded into a shape which generally comprises two sections: a male contact pin dividing portion 541 and a male contact pin supporting portion 542. The male contact pin supporting portion 542 of the male contact insulator contains a fin receiving cavity 543 which conforms to the dimensions of the male interconnect contact fins 532. Accordingly, the male fin insulators are attached to the male fins by completely inserting the male fins into the fin receiving cavity. The male contact pin supporting portion also includes a plurality of support guides 544 formed therein which support subsequently provided male contact pins when they are contacted with female contact pins. The male contact pin dividing portion 541 includes a plurality of male contact pin dividers 545, wherein the male contact pin dividers include a stabilizing face 546.

Upon insertion of the male fin into the fin receiving cavities, the male contact dividing portion 541 is inserted into and divides male contact pin holding openings 538.

Referring to FIG. 8, pairs of male contact pins 510 are inserted through individual male contact pin holding openings 538 into the male fin housing 531. Shown more clearly in FIG. 9C, the male contact pins comprise two basic parts: a conductive projecting pin 511 and a male pin insulator 515.

The conductive projecting pin may be formed of beryllium copper, phosphor copper, brass or other copper alloys and plated with nickel, gold, tin, palladium or an alloy of two or more of nickel, gold, tin, palladium. The conductive projecting pin may be plated on its entire surface or only on the particular portion which comes in contact with the female contact pin.

Each conductive projecting pin comprises three sections: a tapered contact portion 512 for electrically contacting and deflecting the contact portion 112 of the female contact pin 110; an elongated contact portion 513 for electrically contacting the contact portion 112 of the female contact pin 110; and a handling portion 514 for supporting the male pin insulator.

The male pin insulator 515 is a molded product made of electrically insulating material such as Teflon or other suitable material having a hollow axis which allows the male pin insulator to conformably slide over the handling portion 514 of the conductive projecting pin. The male pin insulator comprises two sections 516A and 516B, each having two different exterior shapes. Cylindrical pin insulator portion 516A has an exterior shape which is circular. Faceted pin insulator portion 516B comprises radial dimensions larger than the cylindrical pin insulator portion that yield an exterior shape having a finite rotational symmetry. The exterior shape of the male pin insulator conforms to the dimensions of the male contact pin holding openings 538. The male pin insulator having the shape as described above limits the degree to which the contact portion 512 extends from the back of the male fin housing 531 within the pin supporting portion 542. Accordingly, it is possible to maintain uniform connections electrical connections during a mating of the modular female and male interconnect components.

After the male pin insulator has been disposed over the handling portion 514 of the conductive projecting pin, a predetermined amount of the handling portion is left exposed by the male pin insulator and so is formed a solder connection portion 517 of the conductive projecting pin. The solder connection portion is electrically connected to a subsequently provided printed circuit board (PCB) via subsequently provided solder balls, conductive epoxy or solder paste.

Upon inserting the male contact pins, the conductive projecting pins 511 are disposed within the support guides 544 of the male fin insulators. Further, one of the faceted surfaces contained within the faceted pin insulator portion 516B of the male pin insulator contacts a stabilizing face 546 of the male fin insulators 540 and thereby prevents the conductive projecting pin from undesirably moving within the male contact pin holding openings 538. By preventing the conductive projecting pin from moving, reliability when mating to female contact pins is increased.

Figure 9D:
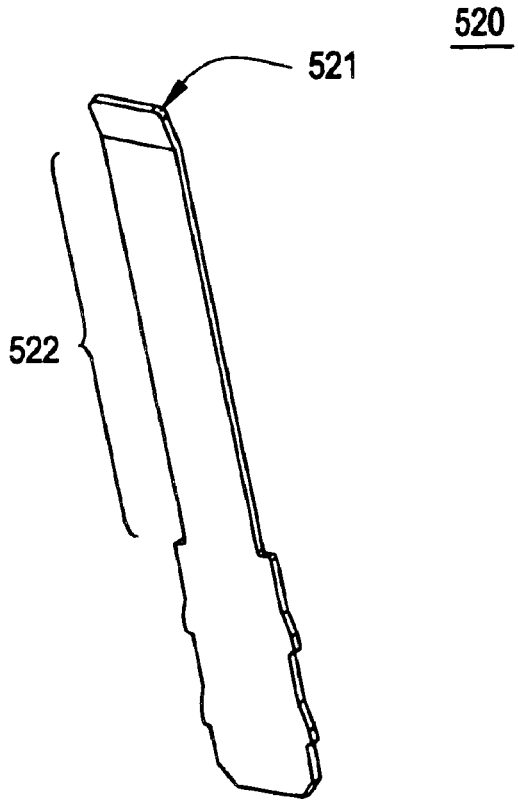

Referring to FIGS. 8 and 9D, shielding contact pins 520 may be formed of a phosphor bronze alloy, plated with a nickel gold alloy, and coined to increase yield stress, are provided within guide grooves 533 formed within the male contact housing and are secured within the corresponding cavities of the male contact housing shell 530.

Figure 9E:
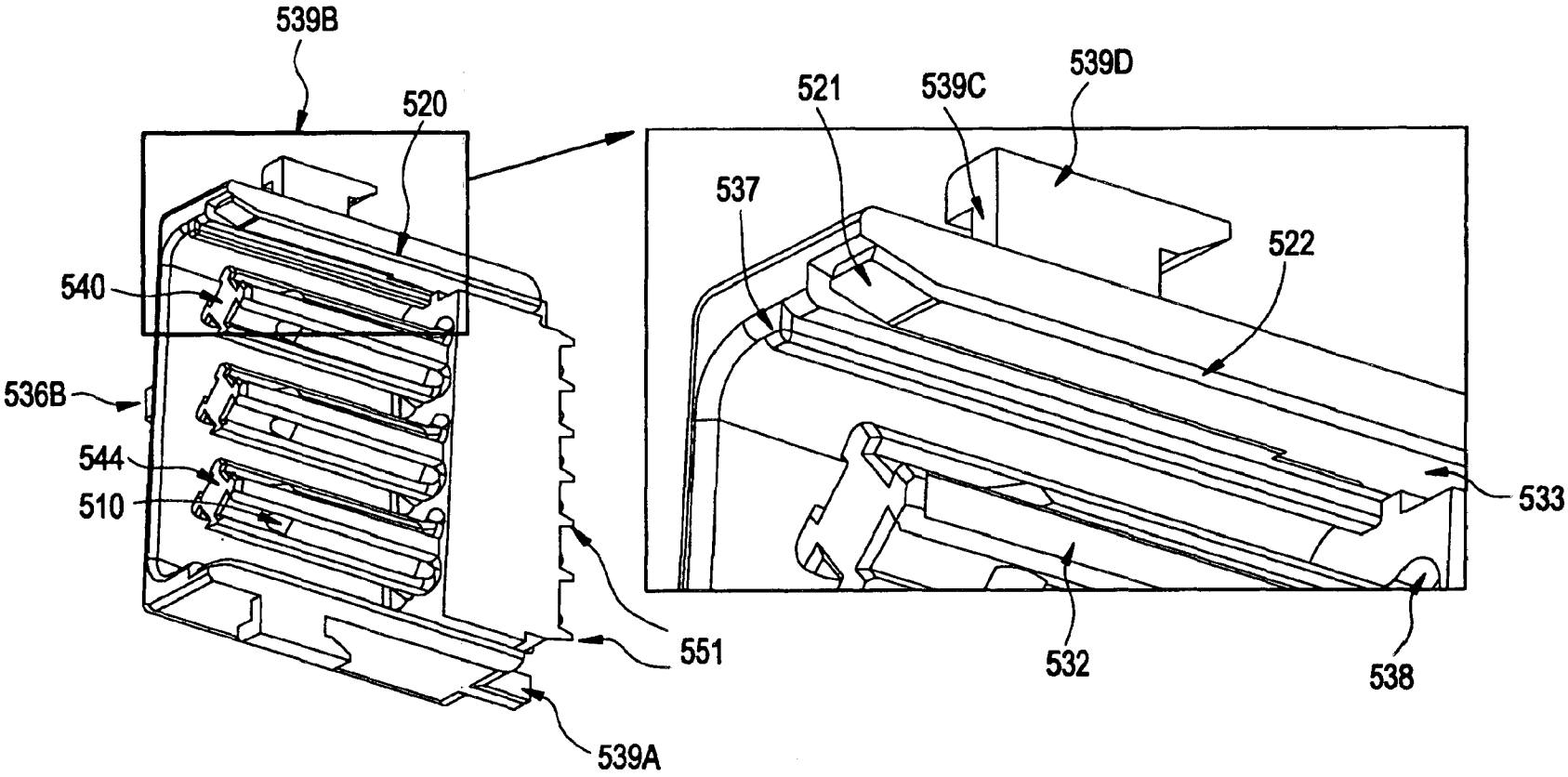

Referring to FIG. 9E, a close up view of the male shielding contact 520 within the guide groove 533 is shown in accordance with an aspect of the present invention. As can be seen, the male shielding contact is deformed to produce a deflection structure 521. During mating of the male interconnect component with the female interconnect component, the deflection structure 521 of the male shielding contact deflects the contact structure 121 of the female shielding contact 120. Subsequently, the contact structure 121 contacts a contact portion 522 of the male shielding contact.

Thus, by assembling the male contact housing 530, the male fin insulators 540, the male contact pins 510, the shielding contact pins 520, and male solder guides 550, a modular male interconnect component 500 is formed.

Figure 10A:
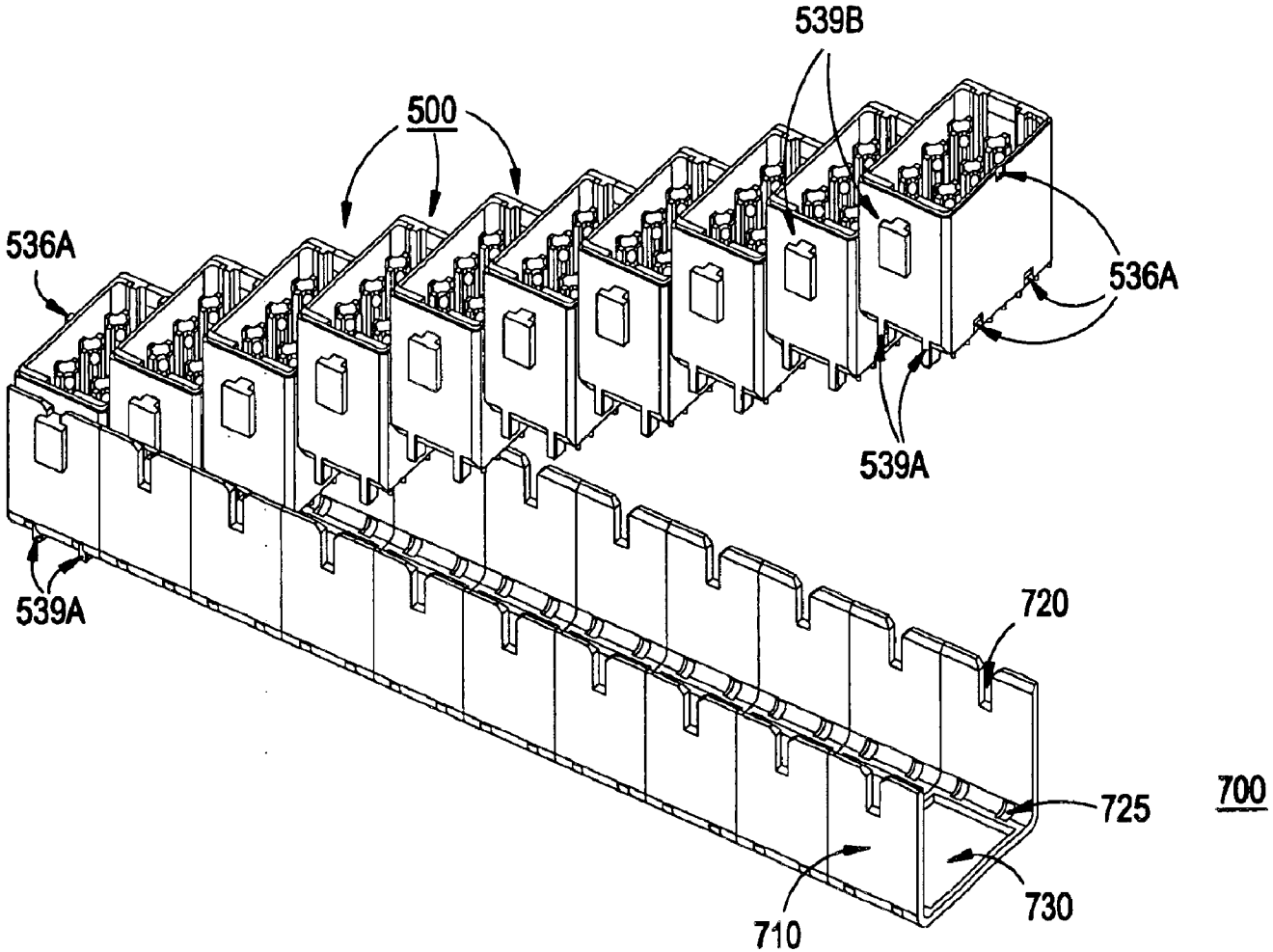
FIGS. 10A–10C illustrate perspective views of a plurality of male interconnect components assembled in a modular frame.
Figure 10B:
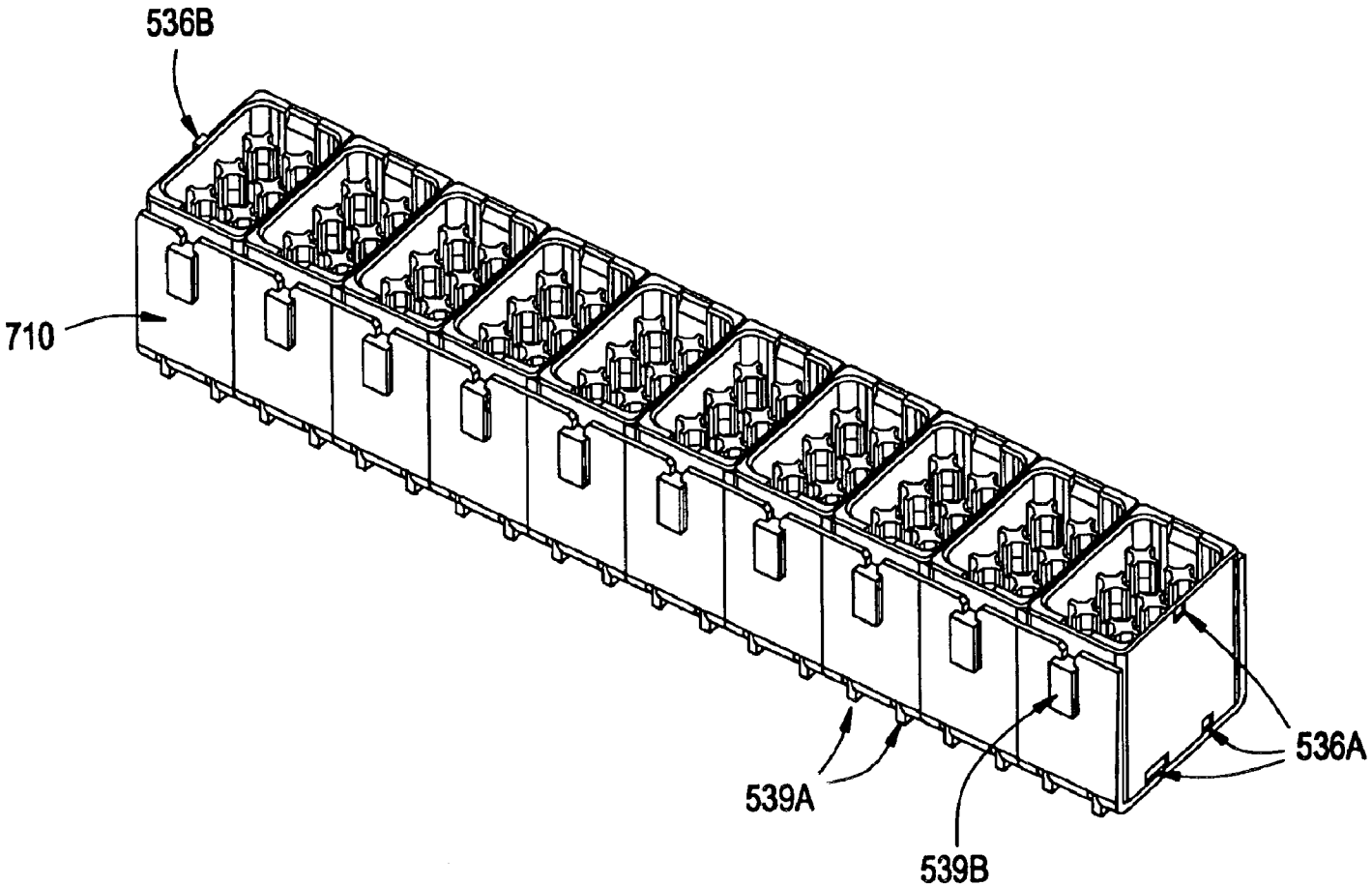
Figure 10C:
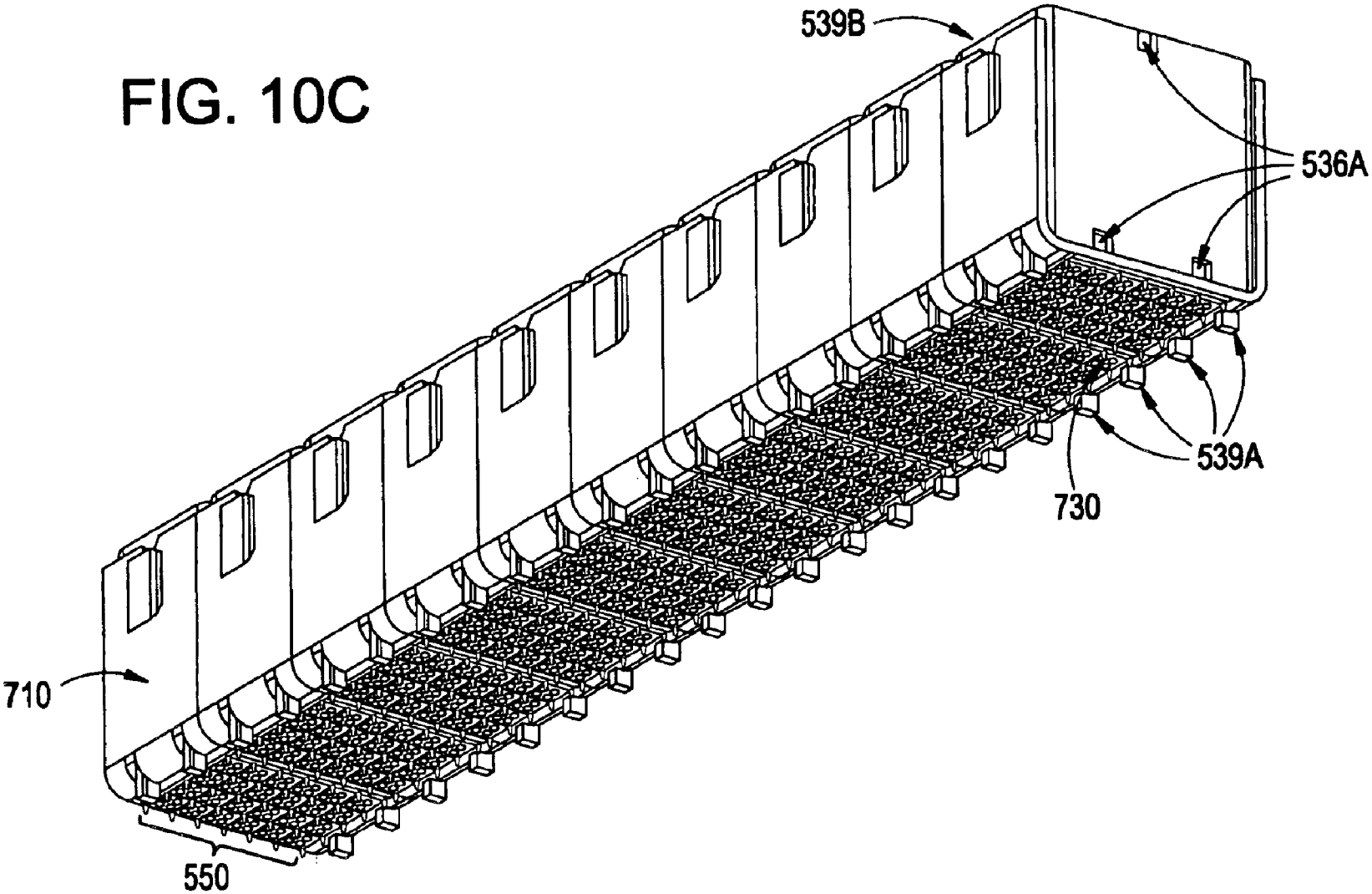

Referring now to FIGS. 10A–10C, a plurality of modular male interconnect components 500 are connected to each other via a male modular frame 700. The male modular frame may be formed of stainless steel, aluminum, carbon fiber or other suitable material.

As shown in FIG. 10A, the male modular frame comprises a single, deformed plate 710, bent in two parallel locations at 90°. Within the deformed plate, holes are cut or punched as is well known in the art. More specifically, frame connection hole 720 is adapted to receive the vertical alignment fin 539C and has a width less than a width of tab 539D. Accordingly, the frame connection hole allows the frame connection means 539B to slide thereinto and thereby fix a vertical movement of the modular male interconnect component. Frame alignment holes 725 is formed within the bent portions of the deformed plate and are configured to receive the modular frame protrusions 539A and thereby prevent the modular male interconnect component from a displacement within the male modular frame. Solder connection hole 730 is formed to receive the PCB connection stage 550.

Referring to FIG. 10A, upon inserting the modular male interconnect components 500, with their respective alignment mechanisms, into the male modular frame 700, modular alignment protrusions 536B found on one modular male interconnect component are fully inserted into modular alignment recesses 536A found in neighboring adjacent modular male interconnect components. By maintaining mated modular alignment protrusions with corresponding recesses, the plurality of male contact pins 510 and solder connection portions 517 within the modular male interconnect components 500 are aligned as shown in FIGS. 10B and 10C, respectively. Consequently, successful mating to modular female interconnect components and connecting to signal contacts in PCBs may be achieved.

Thus, according to one aspect of the invention a completed male or female interconnect component may essentially be characterized as containing a plurality of electrically isolated coaxial signal carrying paths, i.e., contact pins and/or wires of right angle signal pins, wherein the signal carrying paths are electrically insulated from each other using various electrically insulating structures, i.e., fin insulators, contact pin insulators, solder guides, right angle signal pin insulators, in addition to being electrically shielded from each other using various metallized insulating structures, i.e., contact housings, angle bodies, and shielding insulators, shielding contacts, and ground bumps. Given that the angle bodies and the contact housings are mechanically coupled together, they are also electrically connected to one another through the shielding contacts and the metallized surfaces they comprise. Accordingly, the exterior surfaces of the interconnect components shield signal carrying paths from electrical interference, i.e., signal noise within the interconnect components and between neighboring signal carrying paths. Accordingly, the present invention is capable of providing a high density electrical interconnect system that may operate at frequencies above 10 GHz with a substantially reduced amount of cross talk between signal paths and increase signal transmission.

Once connected to their respective PCBs, the male and female interconnect components transmit electrical signals therebetween. For example, a PCB connected to a male interconnect component sends a plurality of electrical signals. Within both the male and female interconnect components, the electrically conductive structures provided to carry each of the signals, i.e., the contact pins and the signal carrying portions of right angle signal pins are both electrically insulated and electrically shielded from each other, except with differential pairs, in which case neighboring contacts serve to quiet the adjacent signal noise.

Figure 11A:
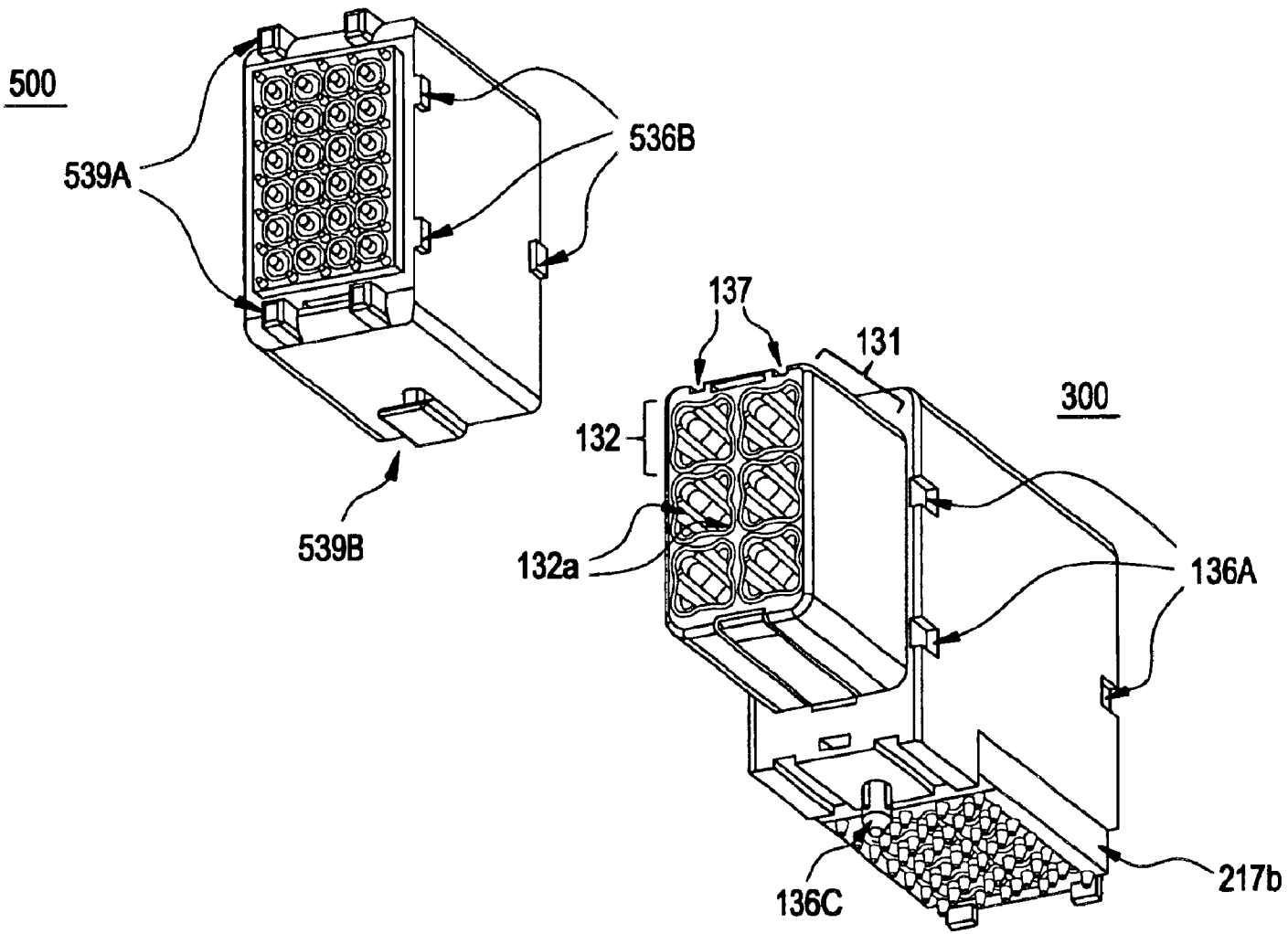
FIGS. 11A–11C illustrate perspective and section views of mated modular male and female interconnect components.
Figure 11B:
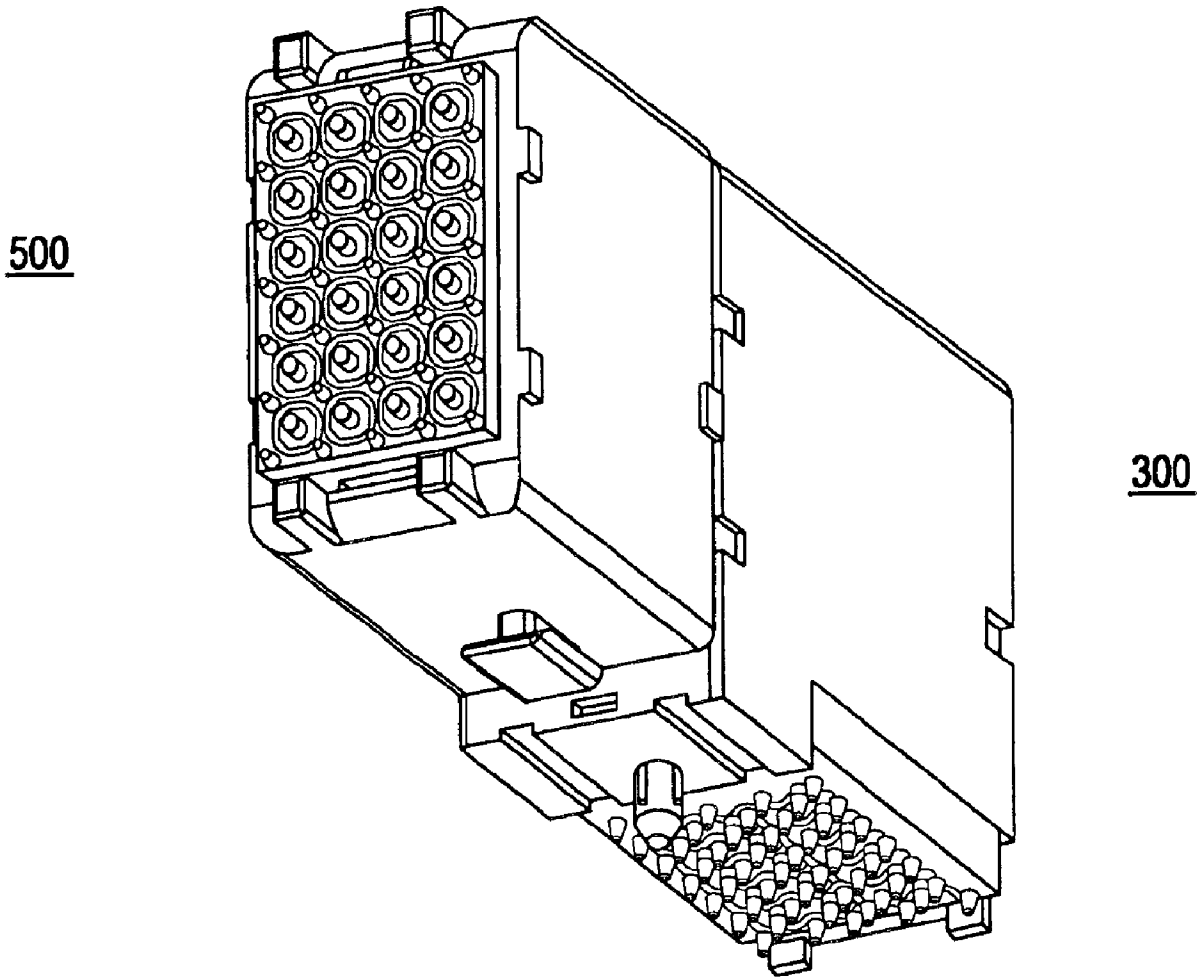

As shown in FIGS. 11A and 11B, the male and female interconnect components formed in accordance with the principles of the present invention are mechanically and electrically connected to each other by arranging the male fin housing 531 and the female contact opening housing 131 proximate one another. The orientation channels 137 are aligned to the orientation keys 537 and the female contact opening housing is then inserted into the male fin housing.

Figure 11C:
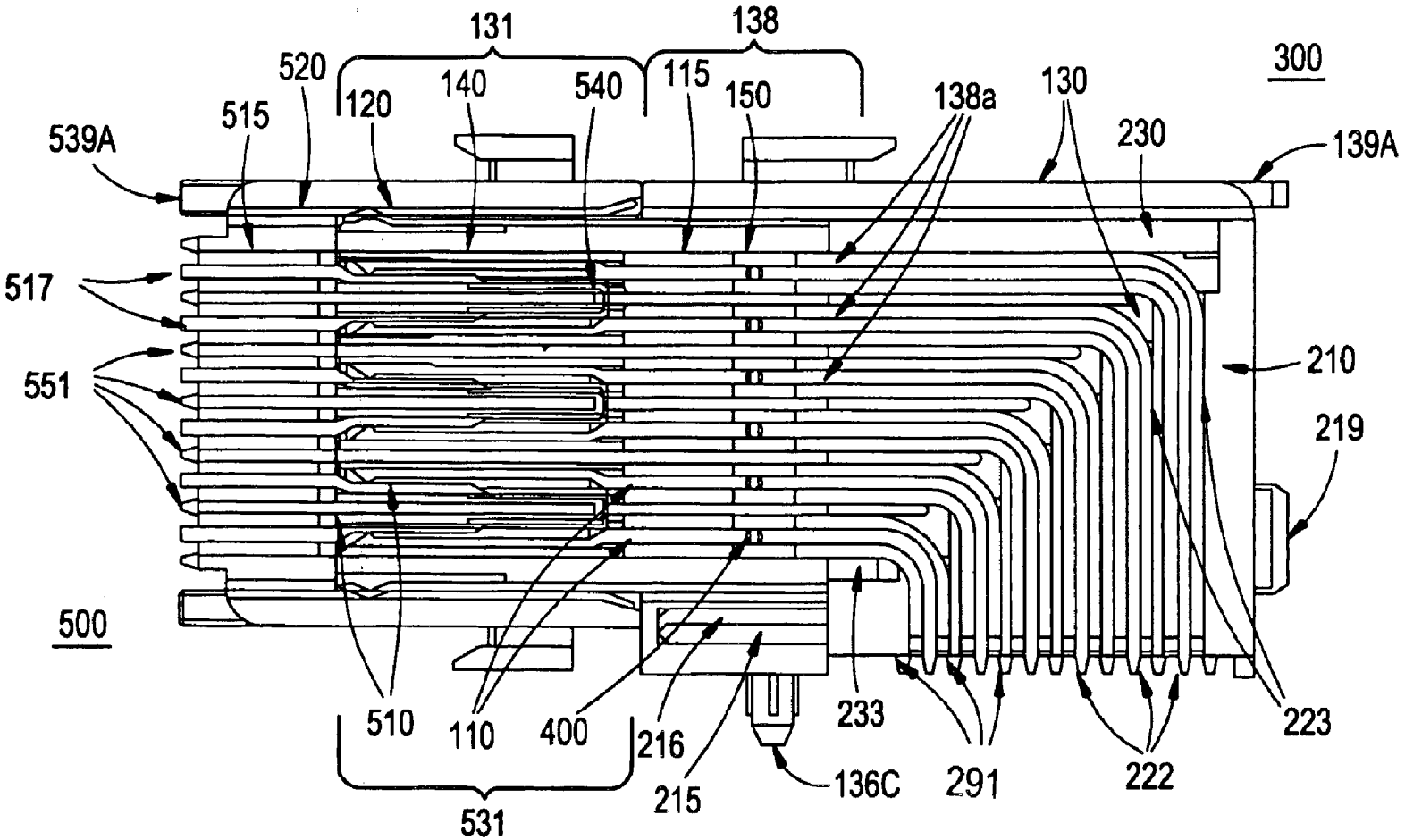

As shown in FIG. 11C, upon insertion, the shielding contacts 120 and 520 of the female and male interconnect components, respectively, slide over one another and electrically connect the grounding mechanisms of the mated devices, thereby reducing cross talk between the signal carrying paths from one PCB to another. Following the connection of the shielding contacts, the male fin insulators 540 are inserted into female contact openings 132. Accordingly, the male contact pins 510, supported by the male fin insulators 540, are inserted into the pin recesses 132*a* to contact the female contact pins 110. Initially, upon contact, the tapered contact portion 512 deflects the contact portion 112 as the male contact pins are inserted into the pin recesses. Even while experiencing maximum deflection, the female contact pins remain electrically insulated from interior sidewalls of the contact openings due to the presence of the optional contact opening insulators 140.

Further, upon the insertion, portions 547 of the male fin insulators contact the upper, lower, and side walls 132*b* of the contact openings 132. Upon completion of the mating process, the contact opening housing 131 is fully inserted within the fin housing 531 and the plurality of male fin insulators 540 are fully inserted and contact the back of the female contact openings. Accordingly, a plurality of electrical signal connections may be made by inserting the male fin insulators and their respective male contact pins into corresponding female contact openings, each containing a plurality of female contact pins. As a result, each individual electrical connection created by a mated female contact pin and male contact pin is electrically insulated from adjacent electrical signal connections due to its location within a pin recess and to the presence of the male fin insulator within the female contact opening.

It will be apparent to those skilled in the art that various modifications and variation can be made in the present invention without departing from the spirit or scope of the invention. Thus, it is intended that the present invention cover the modifications and variations of this invention provided they come within the scope of the appended claims and their equivalents.

What is claimed is:

1. A modular connector assembly comprising:

a modular frame comprising a first surface and a second surface connected at an angle to the first surface by a first angle region, the first surface, second surface, and first angle region having a plurality of first holes, plurality of second holes, and plurality of third holes, respectively, formed therethrough at evenly spaced intervals, and a plurality of modular interconnect components fixable within the modular frame and including a back surface having at least one back surface projection fanned thereon, each comprising:

a contact housing made of electrically insulating material, an exterior of the contact housing comprising first and second side surfaces, a back surface, and a top surface;

a plurality of contact signal pins fixed within and electrically insulated from the contact housing;

a plurality of side protrusions fanned on the first side surface;

a plurality of side recesses formed in the second side surface;

at least one back surface peg formed on the back surface of the contact housing; and top surface modular frame connection means on the top surface, wherein the top surface modular frame connection means is configured for receipt by the first holes, the at least one back surface projection is configured for receipt by the second holes, the at least one back surface peg is configured for receipt by the third holes, and wherein side protrusions of the plurality of modular interconnect components are configured for receipt by side recesses of adjacent ones of the plurality of modular interconnect components.

2. The modular connector assembly according to claim 1, wherein an exterior surface of the contact housing is electrically conductive.

3. The modular connector assembly according to claim 1, wherein each of the plurality of modular interconnect components further comprises:

a plurality of shielding contacts disposed within and electrically coupled to the contact housing.

4. The modular connector assembly according to claim 1, wherein each of the plurality of modular interconnect components further comprises:

a component contact portion and a device contact portion integrally formed within the contact housing;

at least one contact opening formed within the component contact portion;

a plurality of pin openings formed in the device contact portion, each of the plurality of pin openings joining with the at least one contact opening, wherein each of the plurality of contact signal pins comprises a component contact end and, opposing the component contact end, a device contact end, wherein a plurality of component contact ends are disposed within the at least one contact opening, and wherein a plurality of device contact ends are disposed within a single one of the plurality of pin openings, wherein an active electronic device is electrically connectable to the plurality of device contact ends within the plurality of pin openings.

5. The modular connector assembly according to claim 4, wherein pairs of the device contact ends are disposed within a single one of the plurality of pin openings.

6. The modular connector assembly according to claim 4, wherein:

the at least one contact opening comprises a plurality of contact openings; and a plurality of the plurality of pin openings join with each of the plurality of contact openings.

7. The modular connector assembly according to claim 6, wherein each of the plurality of modular interconnect components further comprises:

an angle unit made of an electrically insulating material and a plurality of electrically conductive angle pins provided therein, wherein the plurality of the electrically conductive angle pins are bent at an angle and include first ends extending beyond the angle unit to be electrically connectable to the plurality of device contact ends within the pin openings, wherein the angle unit is interposed between the active electronic device and the plurality of device contact ends, and wherein the at least one back surface projection is integrally formed on a back surface of the angle unit.

8. The modular connector assembly according to claim 7, wherein an exterior surface of the angle unit is electrically conductive.

9. The modular connector assembly according to claim 7, wherein:

the contact housing further comprises a notched slot structure integrally formed therein; and the angle unit comprises a latching means integrally formed therewith, wherein the latching means of the angle unit, electrically connected to the plurality of device contact ends are fixed within the notched slot structure of the contact housing.

10. The modular connector assembly according to claim 8, wherein the exterior surface comprises:

a substantially flat bottom surface; and a plurality of integrally formed ground bumps evenly spaced between second ends of the electrically conductive angle pins, wherein the second ends and the ground bumps protrude from the substantially flat bottom surface to be electrically contactable to the active electronic device.

11. The modular connector assembly according to claim 4, wherein:

the at least one contact opening comprises a single contact opening.

12. The modular connector assembly according to claim 11, wherein the modular frame further comprises a third surface connected at an angle to the second surface by a second angle region, the third surface and the second angle region having a plurality of fourth holes, and a plurality of fifth holes, respectively, formed therethrough at evenly spaced intervals.

13. The modular connector assembly according to claim 11, wherein the back surface of the contact housing comprises the at least one back surface projection.

14. The modular connector assembly according to claim 12, wherein the contact housing further comprises:

a bottom surface; and bottom surface modular frame connection means on the bottom surface, wherein the bottom surface modular frame connection means is configured for receipt by the fourth holes, and wherein the at least one back surface peg is additionally configured for receipt by the fifth holes.

15. The modular connector assembly according to claim 13, wherein the device contact ends extend beyond the at least one back surface projection.

16. The modular connector assembly according to claim 15, wherein the at least one back surface projection comprises a plurality of electrically conductive ground bumps integrally formed therewith, wherein the electrically conductive ground bumps are evenly spaced between the device contact ends.

17. A high density coaxial electrical interconnect system comprising:

a contact housing formed of a unitary body of electrically insulating material, the contact housing comprising a component contact portion and a device contact portion;

at least one contact opening formed within the component contact portion;

a plurality of pin openings formed in the device contact portion, each of the plurality of pin openings joining with the at least one contact opening;

a plurality of signal pins fixed within and electrically insulated from the contact housing, each of the plurality of signal pins comprising a component contact end and, opposing the component contact end, a device contact end, wherein a plurality of component contact ends are disposed within the at least one contact opening, and wherein a plurality of device contact ends are disposed within each of the plurality of pin openings.

18. The high density coaxial electrical interconnect system according to claim 17, further comprising a plurality of shielding contacts disposed within and electrically coupled to the contact housing.

19. The high density coaxial electrical interconnect system according to claim 17, wherein each signal pin includes a handling portion arranged between the component contact end and the device contact end, the interconnect system further comprising a signal pin insulator conformally disposed over a handling portion of each of the plurality of signal pins.

20. The high density coaxial electrical interconnect system according to claim 17, wherein pairs of the device contact ends are disposed within a single one of the plurality of pin openings.

21. The high density coaxial electrical interconnect system according to claim 17, wherein:

the at least one contact opening comprises a plurality of contact openings; and a plurality of the plurality of pin openings join with each of the plurality of contact openings.

22. The high density coaxial electrical interconnect system according to claim 21, further comprising a plurality of contact opening insulators disposed within each of the plurality of contact openings, wherein exterior dimensions of each of the plurality of contact opening insulators are conformal to dimensions of portions of the signal pins and conformal to a sidewall of each of the plurality of contact openings.

23. The high density coaxial electrical interconnect system according to claim 17, further comprising a plurality of solder guides formed of electrically insulating material, each of the plurality of solder guides being provided within a single one of the pin openings, each of the solder guides comprising a plurality of solder holes each adapted to receive one of the plurality of device contact ends.

24. The high density coaxial electrical interconnect system according to claim 23, further comprising solder material disposed within each of the plurality of solder holes.

25. The high density coaxial electrical interconnect system according to claim 23, wherein each of the solder guides further comprises a solder guide divider structure extending between adjacent electrically conductive signal pins.

26. The high density coaxial electrical interconnect system according to claim 17, wherein the at least one contact opening consists of one contact opening.

27. The high density coaxial electrical interconnect system according to claim 26, further comprising:

a plurality of fins integrally formed with the contact housing; and a plurality of fin insulators disposed over each of the plurality of fins, wherein each of the plurality of fin insulators is formed of electrically insulating material and includes exterior dimensions conformal to dimensions of portions of the signal pins and to dimensions of the plurality of fins, wherein a plurality of signal pins are arranged adjacent each of the plurality of fin insulators.

28. The high density coaxial electrical interconnect system according to claim 27, wherein each of the plurality of fin insulators further comprises a fin insulator divider structure extending between portions of adjacent electrically conductive signal pins.

29. The high density coaxial electrical interconnect system according to claim 27, wherein dimensions of the fins comprise two major surfaces.

30. The high density coaxial electrical interconnect system according to claim 29, wherein the two major surfaces are not flat.

31. The high density coaxial electrical interconnect system according to claim 30, wherein the two major surfaces are diametrically configured with respect to each other.

32. The high density coaxial electrical interconnect system according to claim 17, further comprising a plurality of solder guides formed of electrically insulating material, each of the plurality of solder guides being provided within a single one of the pin openings and each of the solder guides comprising a plurality of solder holes each adapted to receive one of the plurality of device contact ends.

33. The high density coaxial electrical interconnect system according to claim 17, further comprising an angle body interposable between an active electronic device and the plurality of device contact ends, the angle body being formed of an electrically insulating material.

34. The high density coaxial electrical interconnect system according to claim 33, wherein the contact housing further comprises a notched slot structure integrally formed therein; and the angle body comprises an integrally formed latching means, wherein the latching means is fixable within the notched slot structure of the contact housing.

35. The high density coaxial electrical interconnect system according to claim 33, wherein an exterior surface of the angle body is electrically conductive.

36. The high density coaxial electrical interconnect system according to claim 33, further comprising a plurality of electrically conductive angle pins provided within the angle body, wherein the plurality of the electrically conductive angle pins are bent at an angle and include first ends extending beyond the angle unit, wherein the plurality of electrically conductive angle pins are electrically connectable to corresponding ones of the plurality of device contact ends within the pin openings.

37. The high density coaxial electrical interconnect system according to claim 36, further comprising a plurality of shielding insulators, each of the shielding insulators covering a predetermined longitudinal length of at least one electrically conductive signal pin.

38. The high density coaxial electrical interconnect system according to claim 37, wherein each of the shielding insulators covers a predetermined longitudinal length of a single electrically conductive signal pin.

39. The high density coaxial electrical interconnect system according to claim 37, wherein each of the shielding insulators covers a predetermined longitudinal length of a plurality of electrically conductive signal pins.

40. The high density coaxial electrical interconnect system according to claim 39, wherein each of the shielding insulators covers a predetermined longitudinal length of a pair of electrically conductive signal pins.

41. The high density coaxial electrical interconnect system according to claim 37, wherein each of the shielding insulators is coated with an electrically conductive material.

42. The high density coaxial electrical interconnect system according to claim 17, wherein an exterior surface of the contact housing is electrically conductive.

43. An electrical interconnect system comprising:

a first unit comprising:

a first contact housing made of an electrically insulating material; and a plurality of first contact pins provided within the first contact housing;

a second unit comprising:

a second contact housing made of an electrically insulating materials; and a plurality of second contact pins provided within the second contact housing;

an angle body made of an electrically insulating material;

a plurality of conductive angle pins provided within the angle body, wherein the plurality of conductive angle pins are bent at an angle and include first ends and second ends opposing the first ends, wherein the first ends extend beyond the angle body and are electrically connectable to the second contact pins, wherein each of the plurality of first contact pins is receivable by a single one of the plurality of second contact pins, and wherein the angle body is interposable between an external device to be connected and the second unit.

44. The electrical interconnect system according to claim 43, wherein the surface of the first contact housing is electrically conductive;

the surface of the second contact housing is electrically conductive; and the surface of the angle body is electrically conductive.

45. The electrical interconnect system according to claim 43, wherein each of the plurality of conductive angle pins comprises at least one electrically conductive wire, wherein a predetermined longitudinal length of the at least one electrically conductive wire is covered with a shielding insulator wherein the shielding insulator including an electrically insulating material.

46. The electrical interconnect system according to claim 45, wherein each of the shielding insulators is coated with an electrically conductive material.

47. The electrical interconnect system according to claim 45, wherein the at least one electrically conductive wire includes a single electrically conductive wire.

48. The electrical interconnect system according to claim 45, wherein the at least one electrically conductive wire includes pairs of adjacent electrically conductive wires.

49. The electrical interconnect system according to claim 44, wherein the angle body further comprises:

a substantially planar bottom surface, and a plurality of integrally formed ground bumps evenly spaced between each of the plurality of second ends of the conductive angle pins for electrically grounding the angle body to a first device, the plurality of second ends protruding from the substantially planar bottom surface of the angle body to be electrically contactable to the external device.

50. The electrical interconnect system according to claim 43, wherein each of the plurality of second contact pins comprises:

a conductive receiving pin configured to receive a single one of the plurality of first contact pins a handling portion arranged between opposing ends of the conductive receiving pin; and a second pin insulator conformally disposed over the handling portion of the conductive receiving pin for fixing the conductive receiving pin within the second contact housing.

51. The electrical interconnect system according to claim 50, wherein each conductive receiving pin is provided within, and is electrically insulated from, the second contact housing.

52. The electrical interconnect system according to claim 50, wherein the second contact housing comprises a plurality of integrally formed second contact openings, wherein a plurality of the conductive receiving pins are arranged within each of the plurality of second contact openings.

53. The electrical interconnect system according to claim 52, further comprising:

a plurality of contact opening insulators disposed within each of the plurality of second contact openings.

54. The electrical interconnect system according to claim 53, wherein each of the plurality of contact opening insulators includes exterior dimensions conformal to dimensions of portions of the conductive receiving pins and conformal to a surface on a sidewall of the contact openings.

55. The electrical interconnect system according to claim 50, further comprising solder material electrically connecting each first end to respective solder connection portions of each of the plurality of conductive receiving pins.

56. The electrical interconnect system according to claim 55, wherein the first ends and the solder material are disposed within, and are electrically insulated from, the second contact housing.

57. The electrical interconnect system according to claim 43, wherein the second contact housing comprises a notched slot structure integrally formed therein; and the angle body comprises a latching means integrally formed therewith, wherein the latching means of the angle body is fixable within the notched slot structure of the second contact housing.

58. The electrical interconnect system according to claim 57, wherein the latching means of the angle body is electrically connectable to the second unit.

59. The electrical interconnect system according to claim 43, wherein the second contact housing is electrically connectable to the angle body.

60. The electrical interconnect system according to claim 43, wherein each of the plurality of first contact pins comprises:

a conductive projecting pin configured to be in receipt of a single one of the plurality of second contact pins;

a handling portion arranged between opposing ends of the conductive projecting pin; and a first pin insulator conformally disposed over the handling portion of the conductive projecting pin and fixing the conductive projecting pin within the first contact housing.

61. The electrical interconnect system according to claim 60, wherein each conductive projecting pin is provided within, and is electrically insulated from, the first contact housing.

62. The electrical interconnect system according to claim 60, further comprising:

a plurality of fins integrally formed with the first contact housing; and a plurality of fin insulators formed of electrically insulating material, the plurality of fin insulator disposable over each of the plurality of fins, wherein each of the plurality of fin insulators includes exterior dimensions that are conformal to dimensions of portions of the conductive projecting pins and conformal to dimensions of the fins, wherein a plurality of the conductive projecting pins are arranged adjacent each of the plurality of fin insulators.

63. The electrical interconnect system according to claim 62, wherein the dimensions of the fins comprise two major surfaces, the two major surfaces are not flat and diametrically oppose one another.

64. The electrical interconnect system according to claim 62, wherein dimensions of the fins comprise two major surfaces.

65. The high density coaxial electrical interconnect system according to claim 64, wherein the two major surfaces are not flat.

66. The high density coaxial electrical interconnect system according to claim 65, wherein the two major surfaces are diametrically configured with respect to each other.

67. The electrical interconnect system according to claim 44, further comprising:

a plurality of first shielding contacts disposed within and electrically coupled to the first contact housing; and a plurality of second shielding contacts disposed within and electrically coupled to the second contact housing, wherein each of the plurality of first contact pins are configured for receipt by a single one of the plurality of second contact pins and each of the plurality of first shielding contacts is configured for receipt by a single one of the plurality of second shielding contacts.

68. The electrical interconnect system according to claim 43, wherein the second unit further comprises press fit pegs integrally formed with the second contact housing for aligning the second ends of the first angle unit with corresponding electrical contacts found on the external device.

69. The electrical interconnect system according to claim 43, wherein the first unit is a male unit; and the second unit is a female unit.

70. An electrical interconnect system comprising:

a first unit comprising a first contact housing and a plurality of first contact pins provided within the first contact housing;

a second unit comprising a second contact housing made of an electrically insulating material, the second contact housing having a notched slot structure integrally formed therein and a plurality of second contact pins provided within the second contact housing;

an angle body made of an electrically insulating material and including an integrally formed latching means;

a plurality of conductive angle pins provided within the angle body, wherein the angle pins being electrically connectable to the second unit, the first angle unit being interposable between an external device connectable to the second unit, wherein the latching means is electrically connectable to the second unit and is fixable within the notched slot structure.

71. A system comprising:

a first unit comprising a unitary first contact housing made of electrically insulating material, and a plurality of conductive projecting pins provided within and electrically insulated from the first contact housing;

a second unit comprising a unitary second contact housing made of electrically insulating material, the second contact housing comprising a plurality of integrally formed second contact openings, and a plurality of conductive receiving pins arranged within each of the plurality of second contact openings and electrically insulated from the second contact housing, wherein each of the plurality of first contact pins is receivable by a single one of the plurality of conductive receiving pins.

72. The system according to claim 71, wherein the surface of the first contact housing is electrically conductive.

73. The system according to claim 71, wherein the surface of the second contact housing is electrically conductive.

74. The system according to claim 71, further comprising:

a plurality of fins integrally formed with the first contact housing;

a plurality of fin insulators formed of electrically insulating material and disposed over each of the plurality of fins, wherein each of the plurality of fin insulators comprises exterior dimensions conformal to dimensions of portions of the conductive projecting pins and dimensions of the fins, wherein a plurality of the conductive projecting pins are arranged adjacent each of the plurality of fin insulators.

75. The system according to claim 74, wherein the fin insulators are contactable by sidewalls of the second contact openings at predetermined locations defined by adjacent ones of the plurality of conductive receiving pins such that the fin insulators are present between each of the plurality of conductive projecting pins received by the plurality of conductive receiving pins.

* * * * *